US007461687B2

(12) United States Patent
Han et al.

(10) Patent No.: US 7,461,687 B2
(45) Date of Patent: Dec. 9, 2008

(54) HEAT EXCHANGER

(75) Inventors: Seongseok Han, Daedeok-gu (KR); Taeyoung Park, Daedeok-gu (KR)

(73) Assignee: Halla Climate Control Corporation, Daedeok-Gu, Daejeon-Si (KR)

( * ) Notice: Subject to any disclaimer, the term of this patent is extended or adjusted under 35 U.S.C. 154(b) by 518 days.

(21) Appl. No.: 10/939,428

(22) Filed: Sep. 14, 2004

(65) Prior Publication Data

US 2005/0056402 A1 Mar. 17, 2005

(30) Foreign Application Priority Data

Sep. 15, 2003 (KR) ..... 10-2003-0063576
Oct. 20, 2003 (KR) ..... 10-2003-0072851
Aug. 23, 2004 (KR) ..... 10-2004-0066469
Aug. 23, 2004 (KR) ..... 10-2004-0066470
Aug. 23, 2004 (KR) ..... 10-2004-0066472

(51) Int. Cl.
*F28F 27/00* (2006.01)
*F28F 27/02* (2006.01)

(52) U.S. Cl. ..... 165/103; 165/96; 165/297; 165/299; 165/100; 165/101; 165/174

(58) Field of Classification Search ..... 165/103, 165/96, 297, 298, 299, 300
See application file for complete search history.

(56) References Cited

U.S. PATENT DOCUMENTS 3,617,036 A * 11/1971 Brown ..... 261/111
4,524,823 A * 6/1985 Hummel et al. ..... 165/174
6,082,448 A 7/2000 Haussmann
6,109,534 A 8/2000 Ito et al.
7,231,962 B2 * 6/2007 Han ..... 165/96

FOREIGN PATENT DOCUMENTS

GB 391556 5/1933

(Continued)

OTHER PUBLICATIONS

Office Action in corresponding Japanese Appln. No. 2004-267436 dated Nov. 14, 2006.

(Continued)

*Primary Examiner*—John K Ford
(74) *Attorney, Agent, or Firm*—Nixon Peabody LLP; Jeffrey L. Costellia

(57) ABSTRACT

The present invention relates to a heat exchanger which can suitably regulate the quantity, the feeding position or the feeding order of heat exchange medium fed into tubes to adjust heat exchange performance according to cooling and heating load. The heat exchanger comprises a plurality of tubes placed at least one header, each tube having both ends fixed to the header, medium-distributing means installed at the header for feeding heat exchange medium to the specific tubes, a tank placed over the medium-distributing means, the tank having a medium-inlet pipe, a medium-outlet pipe and distribution passages for feeding heat exchange medium to specific regions of the medium-distributing means, and medium-regulating means installed at the tank and operated in response to a control signal for adjusting the feed of the heat exchange medium.

19 Claims, 23 Drawing Sheets

FOREIGN PATENT DOCUMENTS

| | | |
|---|---|---|
| JP | 55022504 | 2/1980 |
| JP | 04-263793 | 9/1992 |
| JP | 04-324078 | 11/1992 |
| JP | 2002-081795 | 3/2002 |
| JP | 2002-318031 | 10/2002 |
| KR | 00170234 | 10/1998 |

OTHER PUBLICATIONS

Office Action in corresponding Korean Appln. No. 200410077801.4 dated Oct. 13, 2006.
European Search Report, EP 04 02 1832.3-2301, Mailed Jul. 6, 2006.
Office Action in corresponding Korean Appln. No. 200410077801 dated Oct. 13, 2006.

* cited by examiner

Prior Art

Prior Art

HEAT EXCHANGER

BACKGROUND OF THE PRESENT INVENTION

1. Field of the Invention

The present invention relates to a heat exchanger, in particular, which can suitably regulate the quantity of heat exchange medium fed into tubes to adjust heat exchange performance according to cooling and heating load. More particularly, the heat exchanger of the present invention can selectively regulate or open/close the flow of heat exchange medium therein to control heating or cooling capability, uniformly distribute heat exchange medium through the same, and uniformly maintain the quantity and flow rate of heat exchange medium flowing toward the tubes, thereby preventing lateral temperature difference as well as improving heat exchange performance.

2. Background of the Related Art

As well known in the art, an air conditioning system includes a cooling system and a heating system. In the cooling system, heat exchange medium discharged by the actuation of a compressor circulates through a condenser, a receiver driver, an expansion valve and an evaporator while cooling the vehicle interior through heat exchange in the evaporator. The heating system introduces heat exchange medium (engine cooling water) into a heater core in order to heat the vehicle interior through the heat exchange with the heater core.

The condenser, the evaporator and the heater core are a heat exchanger for performing heat exchange with heat exchange medium. The heat exchanger is fed with heat exchange medium, performs heat exchange with it at a suitable temperature, and then circulates heat exchange medium.

As shown in FIG. 1, a conventional heat exchanger includes a plurality of tubes 5 arranged at a specific interval and having both ends fixed to upper and lower headers 1 and 3, upper and lower tanks 7 and 9 coupled with the upper and lower headers 1 and 3, respectively, to form passages communicating with the ends of the respective tubes 5 and heat radiation fins 11 placed between adjacent ones of the respective tubes to increase heat radiation surface.

When the conventional heat exchanger of the above structure is mounted on an air conditioning system, in particular, to a vehicle air conditioning system, heat exchange medium fed into passages formed by the upper tank 7 and the upper header 1 flow through the first half of the tubes 5 at one side, which are divided by baffles, to perform heat exchange with the ambient air. Then, heat exchange medium U-turns at passages formed by the lower tank 9 and the lower header 3 to flow through the second half of the tubes at the other side to perform heat exchange again, and then discharges through the passages formed by the upper tank 7 and the upper header 1.

In the conventional heat exchanger performing heat exchange as above, since heat exchange medium (vehicle cooling water) is fed regardless of heating or cooling load, additional control means is needed to selectively control heat exchange ability according to heating or cooling load. For example, in the case where the heat exchanger is used as a heater core of a vehicle, the number of rotation of a blower is adjusted or a door is installed in the front of the heat exchanger to adjust air volume, thereby adjusting the heat exchange ability of the heat exchanger. However, since the above scheme of controlling the heat exchange ability through the adjustment of air volume requires an additional apparatus, there is a problem in that control is not reliable.

An approach for solving the above problem is disclosed in Korea Patent No.170234, which is previously filed by the assignee and properly registered. This document proposes a heat exchanger as shown in FIGS. 2 and 3, which includes tubes 5 arranged at an equal interval and having both ends fixed to upper and lower headers 1 and 3, division supplying means 13 connected to the upper header 1 for feeding heat exchange medium to specific ones of the tubes 5 and a lower tank 9 connected to the lower header 3 to communicate with ends of the respective tubes 5.

The division supplying means 13 includes a plurality of communication passages 15 connected with top ends of the tubes 5 coupled with the upper header 1, a body 17 having a cylindrical heat exchange medium-dividing section 19 with inlet sides of the passages 15 being formed in a specific angle range, at least one heat exchange medium-inlet pipe 21 installed to communicate with the heat exchange medium-dividing section 19 in the body 17, a rotary member 23 rotatably mounted on the heat exchange medium-dividing section 19, and having a rotary shaft 25 and cutoff blades 27 mounted on the rotary shaft 25 for selectively closing the inlets of the communication passages 15, and a cover 29 for supporting the rotary shaft 25 and closing the heat exchange medium-dividing section 19.

In this state, heat exchange medium is fed via the heat exchange medium-inlet pipe 21 and the rotary member 23 rotatably mounted on the heat exchange medium-dividing section 19 is rotated according to the load applied to the heat exchanger in order to perform heat exchange with heat exchange medium by using the heat exchanger. Then, the cutoff blades 27 selectively open/close the inlets of the communication passages 15 in response to the rotation of the rotary member 23 to feed heat exchange medium to some or all of the tubes 5.

In the case where the inlets of the communication passages 15 are provided at both sides, the cutoff blades 27 installed at both sides of the rotary member 23 simultaneously open both ends of the tubes 5 to feed heat exchange medium into some of the tubes 5 and the quantity of heat exchange medium can be adjusted in response to the rotation of the rotary member 23 so that the heat exchange ability of the heat exchanger is selectively adjusted.

Heat exchange medium can be selectively fed into the respective tubes 5 of the heat exchanger to selectively adjust the performance of the tubes 5, thereby easily coping with heating or cooling load.

Although the foregoing heat exchanger has an advantage in that it can selectively adjust the quantity of heat exchange medium, there are problems in that heat exchange medium guided by the cutoff blades 27 of the rotary member 23 is excessively crowded in one row of the tubes to lower the mixing ability of heat exchange medium as well as cause a lateral temperature difference to the heat exchanger. Furthermore, in such heat exchanger system, it is not easy to selectively change a supplying order and position of heat exchange medium that is fed to the tubes.

SUMMARY OF THE INVENTION

The present invention has been made to solve the foregoing problems and it is therefore an object of the present invention to provide a heat exchanger capable of selectively adjusting or opening/closing the flow of heat exchange medium therein to properly control heating or cooling capacity, minimize temperature variation, and uniformly distribute heat exchange medium through the same.

It is another object of the present invention to provide a heat exchanger in which distribution holes communicating with tubes, which are grouped by specific numbers, are sized in proportion to the number of the corresponding tubes to uniformly maintain the quantity and the flow rate of heat exchange medium flowing toward the tubes, thereby preventing lateral temperature difference and improving heat exchange performance.

According to an aspect of the present invention for realizing the above objects, there is provided a heat exchanger comprising: a plurality of tubes placed between upper and lower headers, each tube having both ends fixed to the headers; medium-distributing means installed at the upper header for supplying specific tubes with heat exchange medium; an upper tank placed over the medium-distributing means, the upper tank having a medium-inlet pipe, a medium-outlet pipe and distribution passages for supplying specific regions of the medium-distributing means with heat exchange medium; medium-regulating means installed at the upper tank, and operated in response to a control signal; and a lower tank coupled with the lower header to communicate with lower ends of the tubes, and connected with the upper tank via a return pipe.

According to another aspect of the present invention for realizing the above objects, there is provided a heat exchanger comprising: a plurality of tubes that opened inlet and outlet of the tubes are coupled with a header, each tube having return means at a bottom to form a U-shaped passage therein for connecting the inlet and the outlet together; medium-distributing means installed in the header to supply the specific tubes with heat exchange medium; a tank for containing the medium-distributing means and coupled with the header, the tank having a medium-inlet pipe, a medium-outlet pipe and distribution passages therein to supply specific regions of the medium-distributing means with heat exchange medium; and medium-regulating means installed in the tank for operating in response to a control signal.

According to still another aspect of the present invention for realizing the above objects, there is provided a heat exchanger comprising: a plurality of tubes each tube having one end fixed to at least one header; medium-distributing means installed in the upper for supplying the specific tubes with heat exchange medium; a tank placed over the medium-distributing means, the tank having a medium-inlet pipe, a medium-outlet pipe and distribution passages therein for supplying specific regions of the medium-distributing means with heat exchange medium; and medium-regulating means installed at tank, and being operated in response to a control signal to regulate the supply of heat exchange medium.

BRIEF DESCRIPTION OF THE DRAWINGS

The above and other objects, features and advantages of the present invention will be apparent from the following detailed description of the preferred embodiments of the present invention in conjunction with the accompanying drawings, in which.

DETAILED DESCRIPTION OF THE PREFERRED EMBODIMENT

Figure 1:
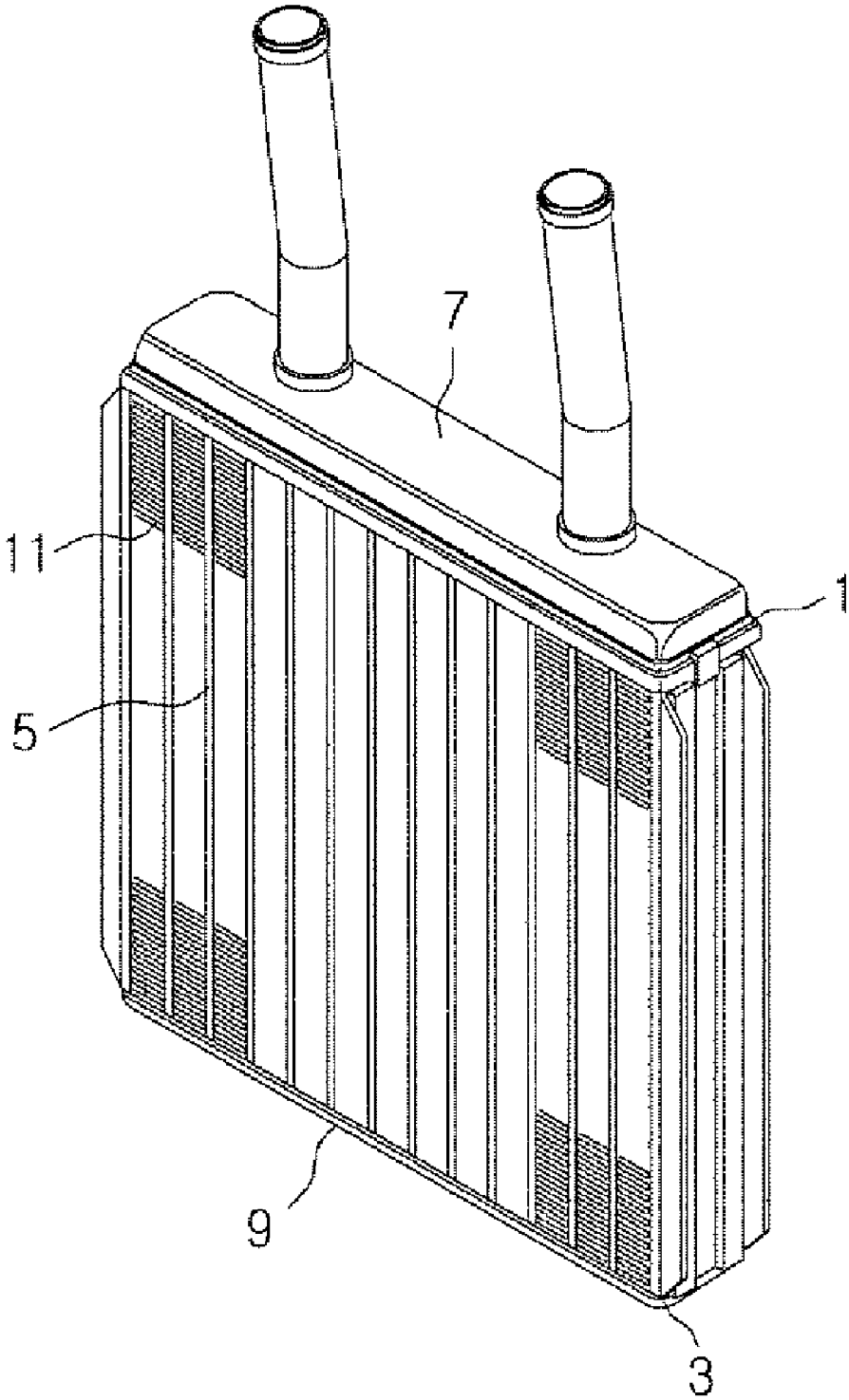
FIG. 1 is a perspective view of a conventional heat exchanger.
Figure 2:
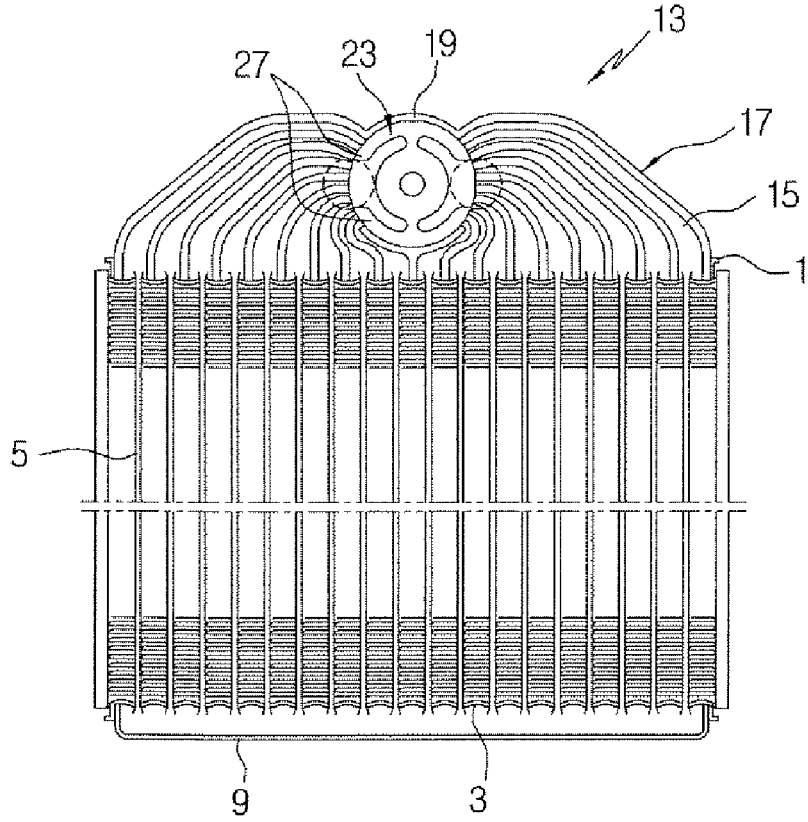
FIG. 2 is a front elevation view of another conventional heat exchanger.
Figure 3:
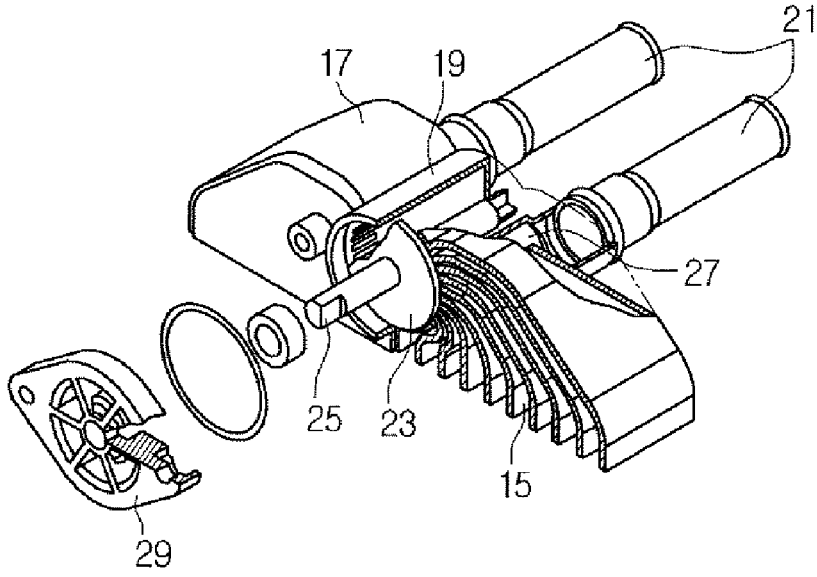
Prior Art Fig. 3
FIG. 3 is an exploded perspective view of important parts of the conventional heat exchanger shown in FIG. 2.
Figure 4:
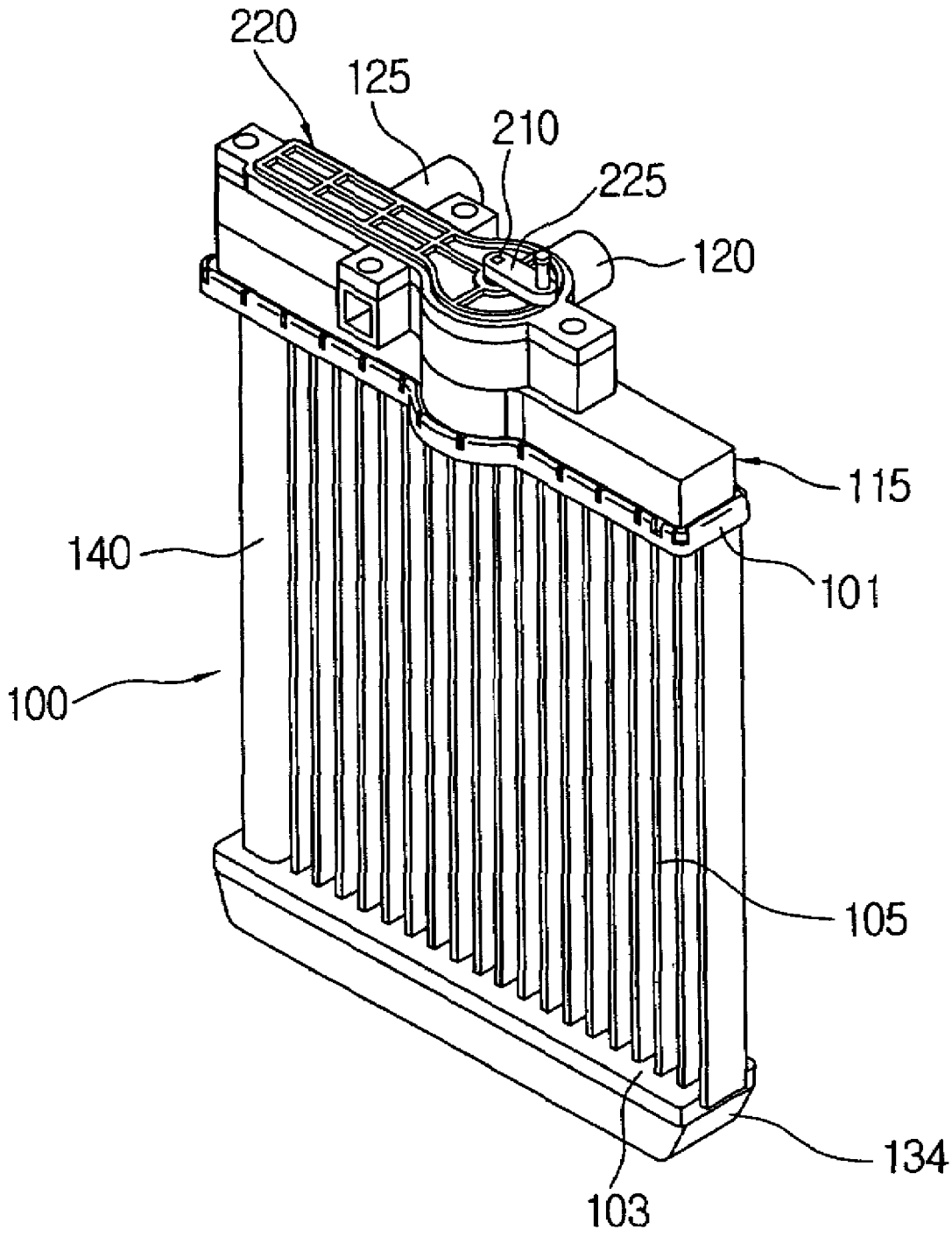
FIG. 4 is a perspective view of a heat exchanger according to a first embodiment of the present invention.
Figure 5:
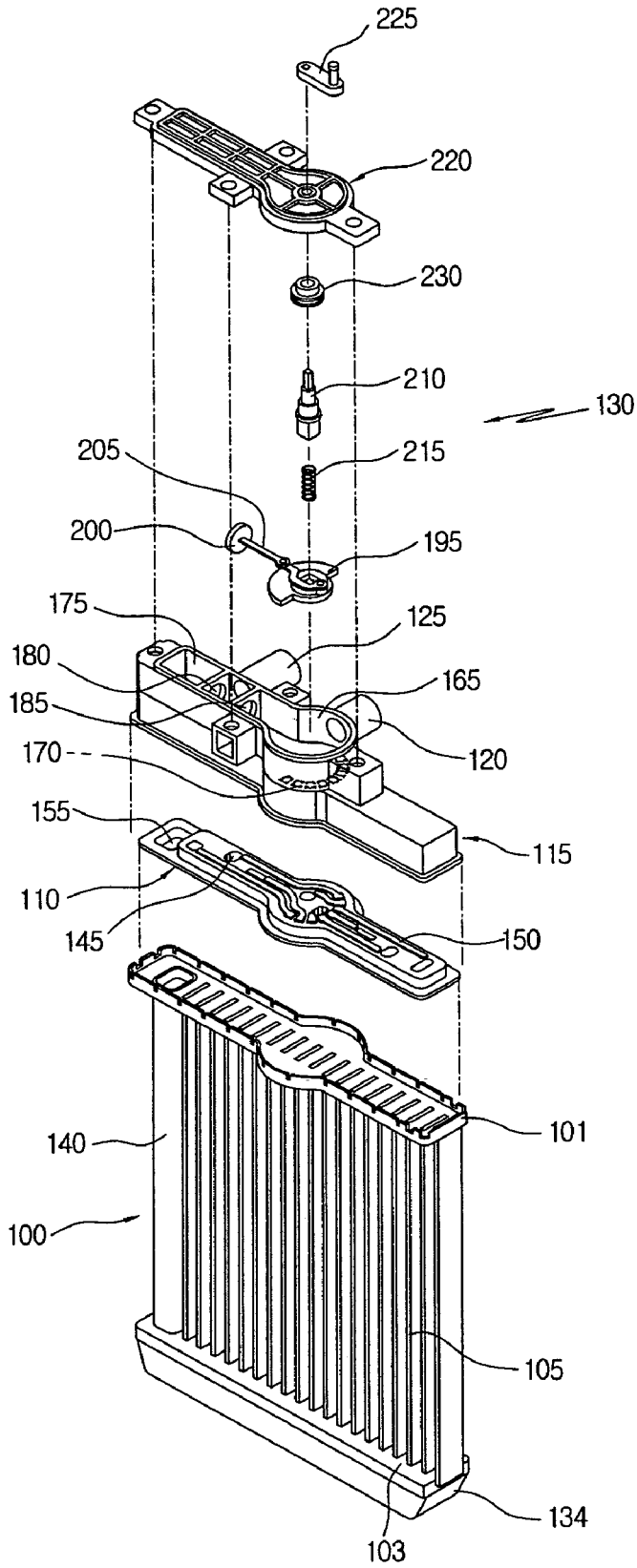
FIG. 5*is* an exploded perspective view of the heat exchanger according to the first embodiment of the present invention.
Figure 6:
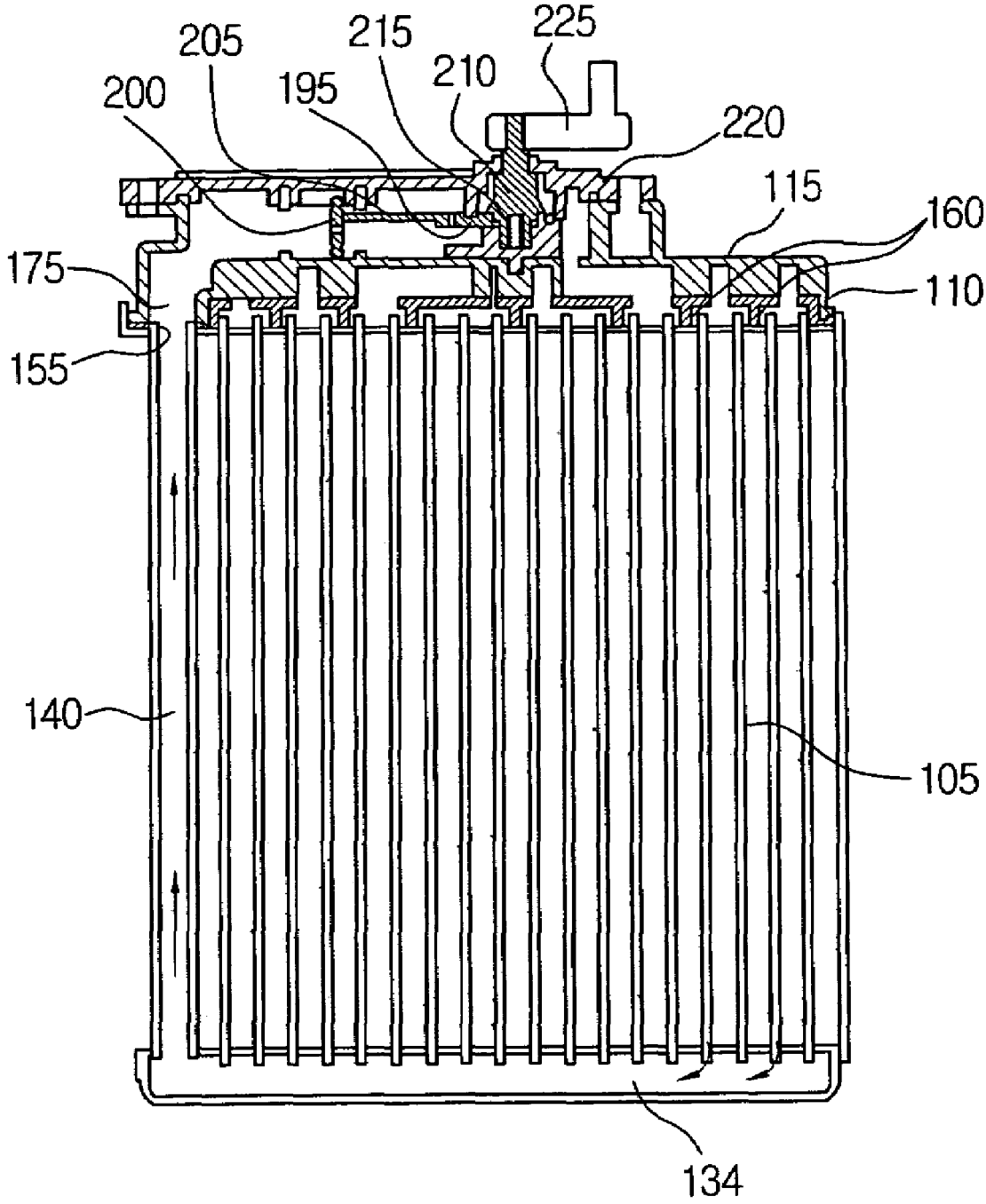
FIG. 6 is a cross-sectional view of the heat exchanger according to the first embodiment of the present invention.
Figure 7:
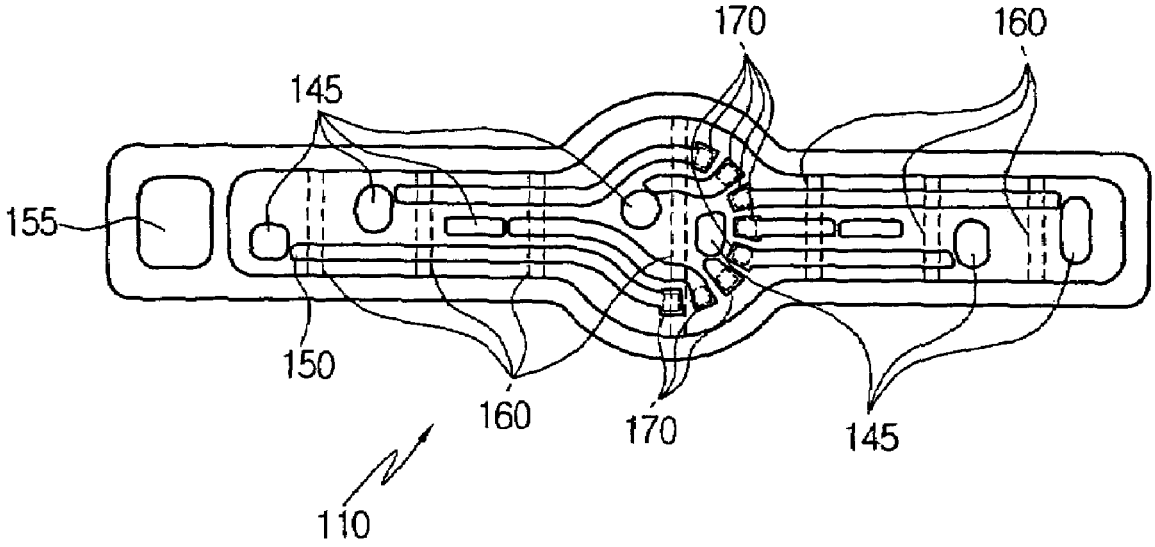
FIG. 7 is a plan view of medium-distributing means in the heat exchanger according to the first embodiment of the present invention.
Figure 8:
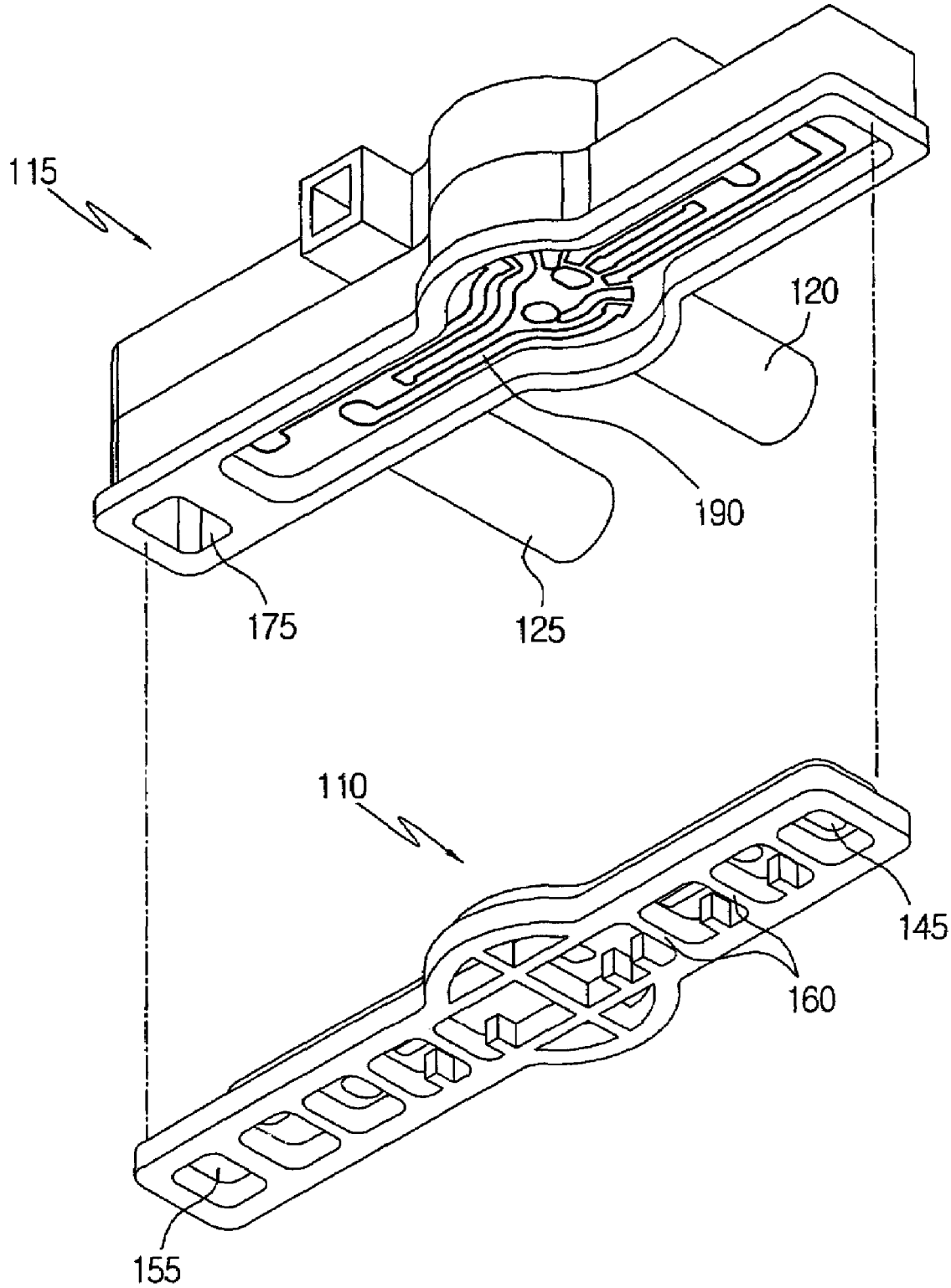
FIG. 8 is an exploded bottom view of an upper tank and the medium-distributing means in the heat exchanger according to the first embodiment of the present invention.
Figure 9:
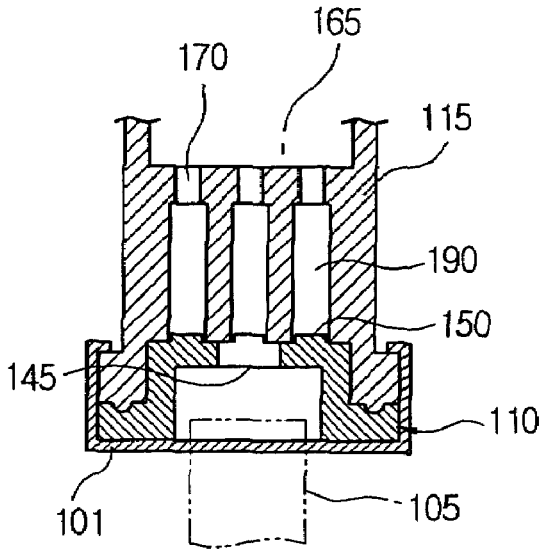
FIG. 9 is a cross-sectional view illustrating an assembled state of the upper tank and the medium-distributing means in the heat exchanger according to the first embodiment of the present invention.
Figure 10:
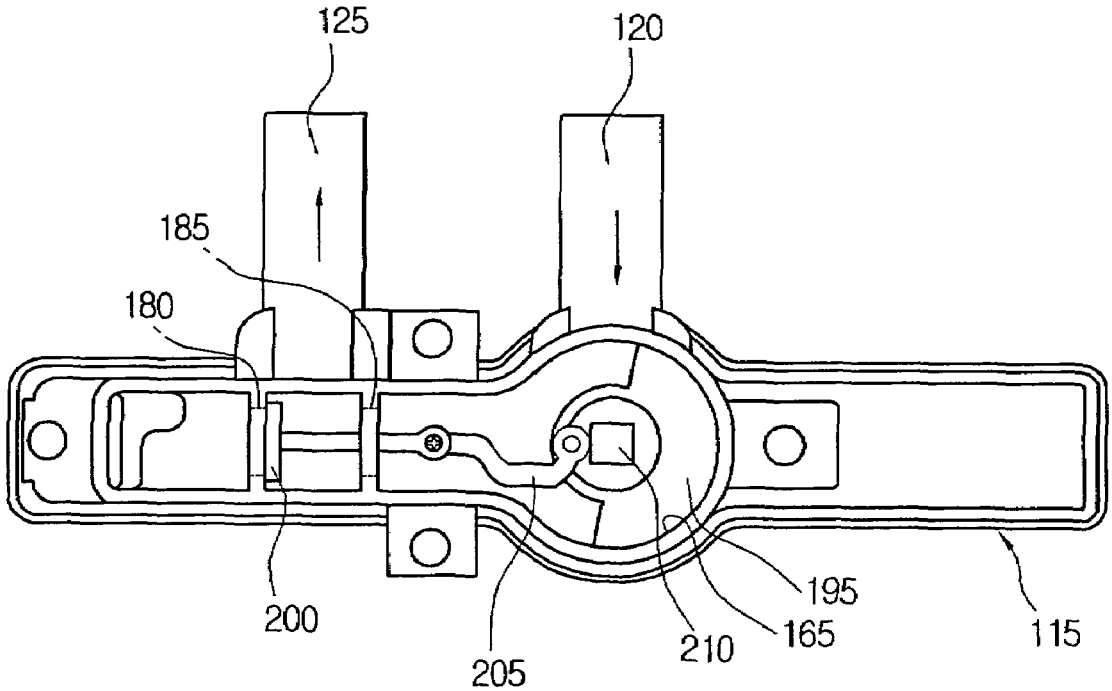
FIGS. 10 to 12 are plan views illustrating an operation status of the heat exchanger according to the first embodiment of the present invention.
Figure 11:
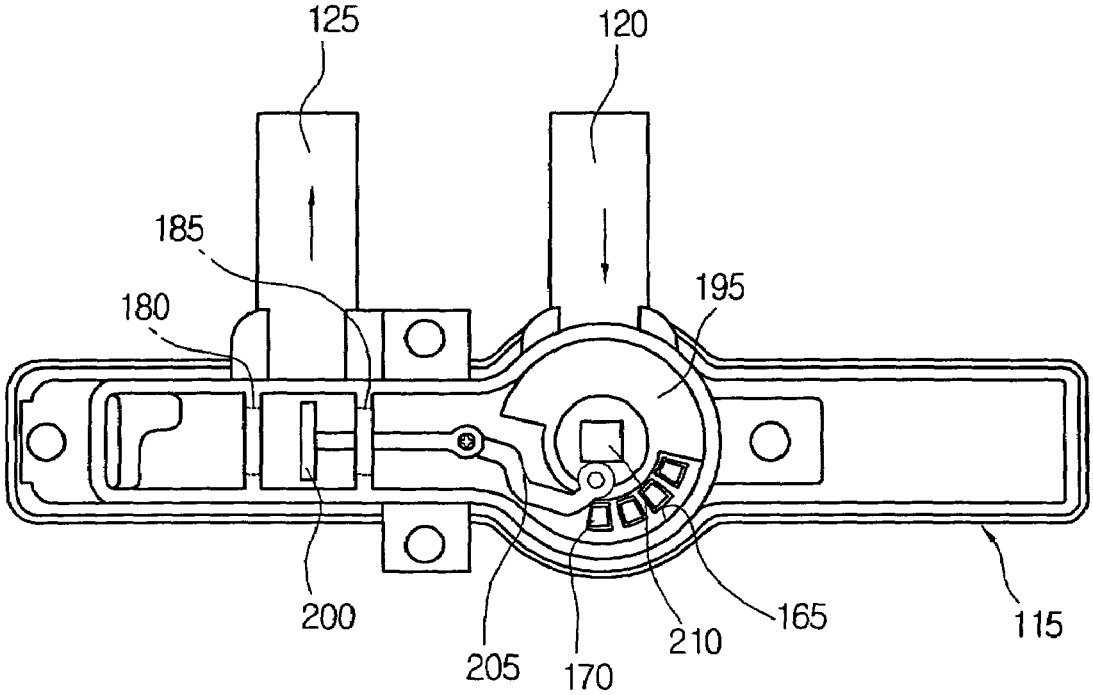
Figure 12:
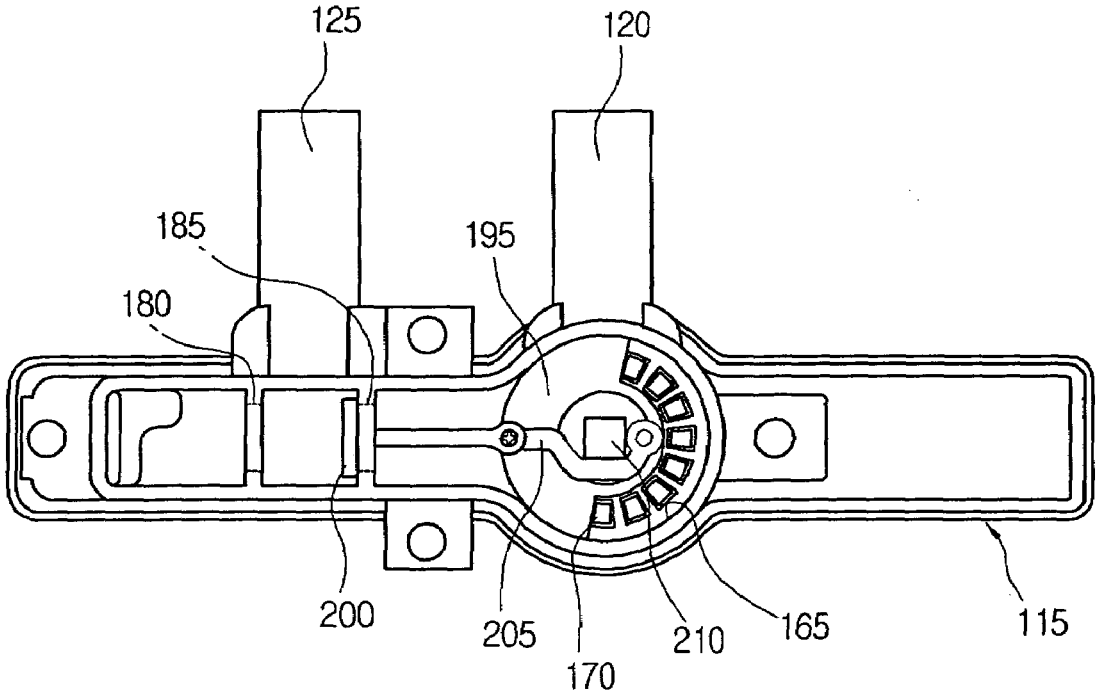
Figure 13:
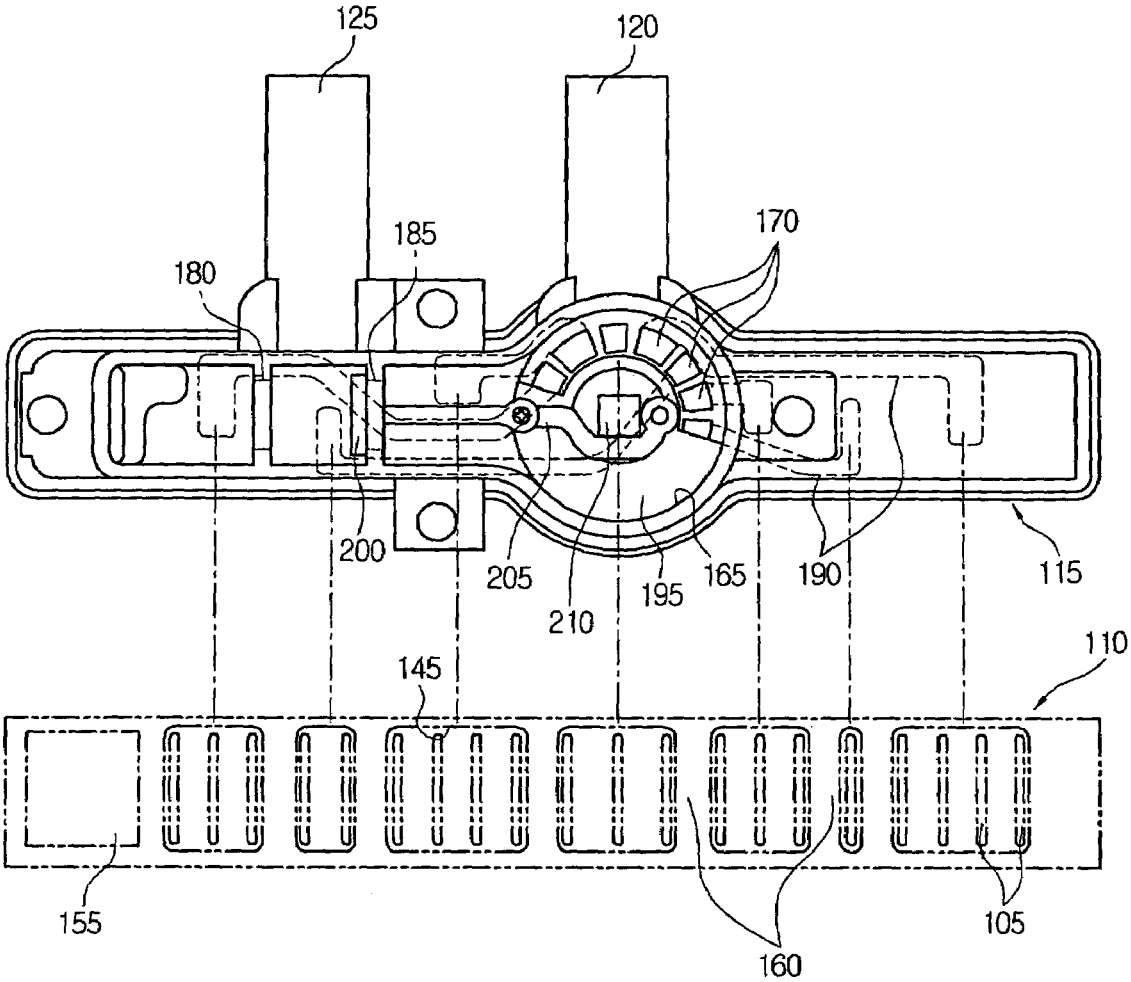
FIG. 13 is a plan view of distribution holes in the upper tank of the heat exchanger according to the first embodiment of the present invention, in which the distribution holes are sized in proportion to the number of the corresponding tubes.

Reference will now be made in detail to the preferred embodiments of the present invention, examples of which are illustrated in the accompanying drawings, in which FIG. 4 is a perspective view of a heat exchanger according to a first embodiment of the present invention, FIG. 5 is an exploded perspective view of the heat exchanger according to the first embodiment of the present invention, FIG. 6 is a cross-sectional view of the heat exchanger according to the first embodiment of the present invention, FIG. 7 is a plan view of medium-distributing means in the heat exchanger according to the first embodiment of the present invention, FIG. 8 is an exploded bottom view of an upper tank and the medium-distributing means in the heat exchanger according to the first embodiment of the present invention, FIG. 9 is a cross-sectional view illustrating an assembled state of the upper tank and the medium-distributing means in the heat exchanger according to the first embodiment of the present invention, FIGS. 10 to 12 are plan views illustrating an operation status of the heat exchanger according to the first embodiment of the present invention, FIG. 13 is a plan view of distribution holes in the upper tank of the heat exchanger according to the first embodiment of the present invention, in which the distribution holes are sized in proportion to the number of the corresponding tubes.

As shown in FIGS. 4 to 13, a heat exchanger 100 according to the first embodiment of the present invention includes a plurality tubes 105 placed between upper and lower headers 101 and 103, in which each tube 105 has both ends fixed to the headers 101 and 103 and is designed to allows the passage of heat exchange medium therethrough, medium-distributing means 110 installed at the upper header 101 for feeding heat exchange medium to a specific one or all of the tubes 105, an upper tank 115 placed over the medium-distributing means 110. The upper tank 115 has a medium-inlet pipe 120 for feeding heat exchange medium, a medium-outlet pipe 125 for discharging heat exchange medium and distribution passages 190 formed therein for feeding heat exchange medium to specific regions of the medium-distributing means 110. The heat exchanger 100 also includes medium-regulating means 130 installed at the upper tank 115, which is automatically operated in response to a control signal to specify the quantity of heat exchange medium to be fed. The heat exchanger 100 also includes a lower tank 134 coupled with the lower header 103 to communicate with lower ends of the tubes 105, and connected to the upper tank 115 so that heat exchange medium flows (returns) to the upper tank 115 via a return pipe 140.

In addition, as not shown in the drawings, heat radiation fins for promoting heat exchange may be further interposed between tubes 105.

First, in order to feed heat exchange medium into the tubes 105 without flow resistance, the medium-distributing means 110 has a number of supply holes 1.45 in suitable positions, in which each of the supply holes 145 communicates with specific ones of the tubes 105. The medium-distributing means 110 also has guides 150 in an upper part to close opened lower ends of the distribution passages 190 so that heat exchange medium flowing through the distribution passages 190 can be guided into the supply holes 145. The medium-distributing means 110 also has a recovery hole 155 for communicating with the return pipe 140 so that heat exchange medium flowing through the return pipe 140 can be introduced toward the upper tank 115.

The medium-distributing means 110 is made of rubber or synthetic resin, and installed between the upper tank 115 and the upper header 101 of the heat exchanger 100 in order to minimize heat transfer to the tube 105 in the bypass of heat exchange medium.

In addition, partitions 160 are placed between adjacent ones of the supply holes 145 which are respectively formed in the medium-distributing means 110.

The partitions 160 allows heat exchange medium, which is fed via the supply holes 145, to flow into the specific tubes 105 divided by the partitions 160.

In addition to the guides 150 and the partitions 160 of the medium-distributing means 110, modification to the position and configuration of the distribution passages 190 of the upper tank 115 allows selective adjustment imparting more various change to the number and configuration of the passages of heat exchange medium flowing into the divided specific tubes 105, thereby improving temperature straightness that is able to regularly control a changing rate of temperature (gradient). The improvement of the temperature straightness enables precise temperature control.

The upper tank 115 includes a circular guide section 165 communicating with the medium-inlet pipe 120, a number of distribution holes 170 at the bottom of the guide section 165, in which the distribution holes 170 are placed radially at an equal interval to feed heat exchange medium into the medium-distributing means 110 via the distribution passages 190, and a recovery section 175 communicating with the recovery holes 155 so that heat exchange medium flowing through the return pipe 140 and the recovery hole 155 can discharge to the medium-outlet pipe 125.

The upper tank 115 has a recovery guide hole 180 formed at one side from the medium-outlet pipe 125, in which the recovery guide hole 180 allows the recovery section 175 to communicate with the medium-outlet pipe 125. At the other side of the upper tank 115 from the medium-outlet pipe 125, a bypass hole 185 is formed allowing the guide section 165 to communicate with the medium-outlet pipe 125.

The recovery guide hole 180 allows heat exchange medium, which is returned through the return pipe, to discharge through the medium-outlet pipe 125. On the other hand, the bypass hole 185 bypasses heat exchange medium, which is fed through the medium-inlet pipe 120, directly into the medium-outlet pipe 125.

In the meantime, the distribution passages 190 are formed in a lower part of the upper tank 115 corresponding to the guides 150 of the medium-distributing means 110. The distributing passages 190 are provided at a suitable interval corresponding to the guide 150 and the supply holes 145, and have leading ends communicating with the distribution holes 170 of the guide section 165 and rear ends extended to the supply holes 145 to communicate therewith.

The distribution passages 190 form closed passages when coupled with the guides 150 so that heat exchange medium fed through the distribution holes 170 of the guide section 165 can stably flow into the supply holes 145 of the mediuni-distributing means 110.

The medium-regulating means 130 includes a valve body 195 placed in the guide section 165 of the upper tank 115 to selectively open/close (partially or completely) an entrance of the distribution holes 170 and an auxiliary valve body 200 connected to the valve body 195 via a link 205. The auxiliary valve body 200 is moved forward/backward in response to the rotation of the valve body 195 to selectively open/close the recovery guide hole 180 or the bypass hole 185.

The valve body 195 is automatically controlled and rotated by a control switch (not shown). A rotary member 210 is installed at the valve body 195 via an elastic member 215, and a cover 220 is installed to rotatably support atop end of the rotary member 210 while sealing a top portion of the upper tank 115 from the outside.

In addition, an auxiliary rotary member 225 is placed at the top end of the rotary member 210, which is projected out of the cover 220, and connected to an actuator (not shown).

Herein, the valve body 195 is preferably made of Teflon or urethane in order to improve heat resistance and sealing ability.

The elastic member 215 comprises for example a spring so that the valve body 195 can be tightly pressed against the bottom of the guide section 165, and a sealing member 230 is placed between the rotary member 210 and the cover 220 to maintain the cover 220 and the upper tank 115 in a sealed state.

In addition, where the valve body is made of synthetic resin, rubber may be coated on the valve body 195. In case that the valve body 195 is coated stepwise with synthetic resin and rubber, it is possible to enhance the sealing ability between the distribution holes 170 and the valve body 195.

While the return pipe 140 is preferably shaped into a slot or rectangle to enhance heat transfer efficiency, the return pipe 140 may be substituted with one or more tubes 105.

While the distribution holes 170 in the guide section 165 of the upper tank 115 are equally and uniformly sized in the above description, the distribution holes 170 are preferably sized in proportion to the number of the corresponding tubes communicating with each of the distribution holes 170 as shown in FIG. 13.

That is, a distribution hole 170 is sized larger if a larger number of the tubes 105 correspond to the distribution hole 170, but sized smaller if a smaller number of the tubes 105 correspond thereto. In this way, when heat exchange medium is introduced through the medium-inlet pipe 120 into the guide section 165 and then flows through the medium distribution holes 170, the quantity of heat exchange medium is regulated in proportion to the number of the tubes 105 corresponding to the respective medium distribution holes 170 so that heat exchange medium is uniformly distributed in the respective tubes 105 while maintaining uniform quantity and flow rate through the respective tubes 105, thereby preventing lateral temperature difference in the tubes and heat exchange ability.

FIG. 13 illustrates a modification in which the distribution holes 170 are modified in size, arrangement and shape and the distribution passages 190 are also modified in arrangement and shape. The distribution holes 170 and the distribution passages 190 can be modified more variously in addition to the above structure.

In addition, the number of the tubes communicating with the medium-distributing means 110 and the supply holes 145 can be altered more variously according to the various modifications of the distribution holes 170 and the distribution passages.

Preferably, the distribution passages 190 communicating with the distribution holes 170 and the supply holes 145 formed in the medium-distributing means 110 can be sized in proportion to the number of the tubes 105 communicating with the distribution passages 190 and the supply holes 145.

As described hereinbefore, the heat exchanger according to the first embodiment of the present invention is realized by coupling the upper headers 101 and 103 with both ends of the tubes 105 and the return pipe 140, installing the top tank 115 mounted with the medium-distributing means 110 and the medium-regulating means 130 in the upper header 101, and installing the lower tank 134 in the lower header 103.

Therefore, when heat exchange medium is fed into the guide section 165 via the medium-inlet pipe of the upper tank 115, the medium-regulating means 130 is controlled to bypass heat exchange medium directly into the medium-outlet pipe 125, or heat exchange medium flows through the tubes 105 via the distribution holes 170 to perform heat exchange with the ambient air and then discharges via the return pipe 140 into the medium-outlet pipe 125.

A circulation process of heat exchange medium will be described in more detail as follows:

In the circulation of heat exchange medium, when the auxiliary rotary member 225 is rotated to a specific angle, the valve body 195 rotates to open some of the distribution holes 170, which in turn communicate with the corresponding distribution passages 190 and the supply holes 145, and then the associated supply holes 145 communicate with the specific tubes 105 which are divided into several groups by the partitions 160 that are placed at both sides.

Therefore, heat exchange medium fed via the medium-inlet pipe 120 flows along the specific tubes 105 communicating with the distribution holes 170, which are opened in response to the rotation of the valve body 195, to perform heat exchange with the ambient air, and then flows into the lower tank 134.

After having flown into the lower tank 134, heat exchange medium flows to the upper tank 115 via the return pipe 140, and then passes through the recovery guide hole 180 to discharge to the medium-outlet pipe 125.

As described above, when operated by the link 204 in response to the rotation of the valve body 195 to a specific angle, the auxiliary valve body 200 is placed between the recovery guide hole 180 and the bypass hole 185 but does not completely closes any of the recovery guide hole 180 and the bypass hole 185. Then, when heat exchange medium flows into the medium-outlet pipe 125 after having returned through the return pipe 140, a portion of heat exchange medium fed through the medium-inlet pipe 120 into the guide section 165 flows into the medium-outlet pipe 125 directly through the bypass hole 185.

That is, if a larger number of the distribution holes 170 are opened in response to the rotation of the valve body 195, the auxiliary valve body 200 is moved toward the bypass holes 185 so that less heat exchange medium can flow through the bypass hole 185. However, if a smaller number of the distribution holes 170 are opened, the auxiliary valve body 200 is moved toward the recovery guide hole 180 so that more heat exchange medium can flow through the bypass hole 185.

When the auxiliary valve body 225 is completely rotated, the whole distribution holes 170 are opened in response to the rotation of the valve body 195, and therefore communicate with the whole tubes 105 via the distribution passages 190 and the supply holes 145.

As a result, after flowing through the whole tubes 105 via the totally opened distribution holes 170 and then the distribution passages 190 and the supply holes 145 while performing active heat exchange with the ambient air, heat exchange medium flows into the lower tank 134.

After having flown into the lower tank 134, heat exchange medium returns into the upper tank 115 via the return pipe 140, and then discharges into the medium-outlet pipe 125.

When the valve body 195 is completely rotated to open the whole distribution holes 170, the auxiliary valve body 200 completely opens the recovery guide hole 180 but completely closes the bypass hole 185 so that heat exchange medium fed through the medium-inlet pipe flows entirely toward the tubes 105.

On the contrary, when the valve body 195 is rotated to closed the entire distribution holes 170, the auxiliary valve body 200 completely opens the bypass hole 185 but completely closes the recovery guide hole 180 so that the entire quantity of heat exchange medium fed through the medium-inlet pipe 120 discharges directly through the bypass hole 185 to the medium-outlet pipe 125.

In addition, the guide section 165 is formed in a central portion of the heat exchanger 100, and the distribution passages 190, the guides 150 and the supply holes 145 are designed to spread into both sides from the guide section 165. Then, in response to the operation range of the valve body 195, it is possible to selectively control heat exchange medium to flow into specific ones of the tubes 105, which are divided into plural areas, thereby improving mixing ability as well as enabling precise temperature control through stepwise adjustment.

Furthermore, the flowing path of heat exchange medium can be specified freely to stably adjust temperature straightness. Since the distribution passages 190, the guides 150 and the supply holes 145 can be provided into various forms so that the flowing path of feed heat exchange medium into the tubes 105 can be set freely. Also, the partitions 160 can be placed in suitable positions with respect to the supply holes 145 to primarily specify the quantity of heat exchange medium.

Figure 14:
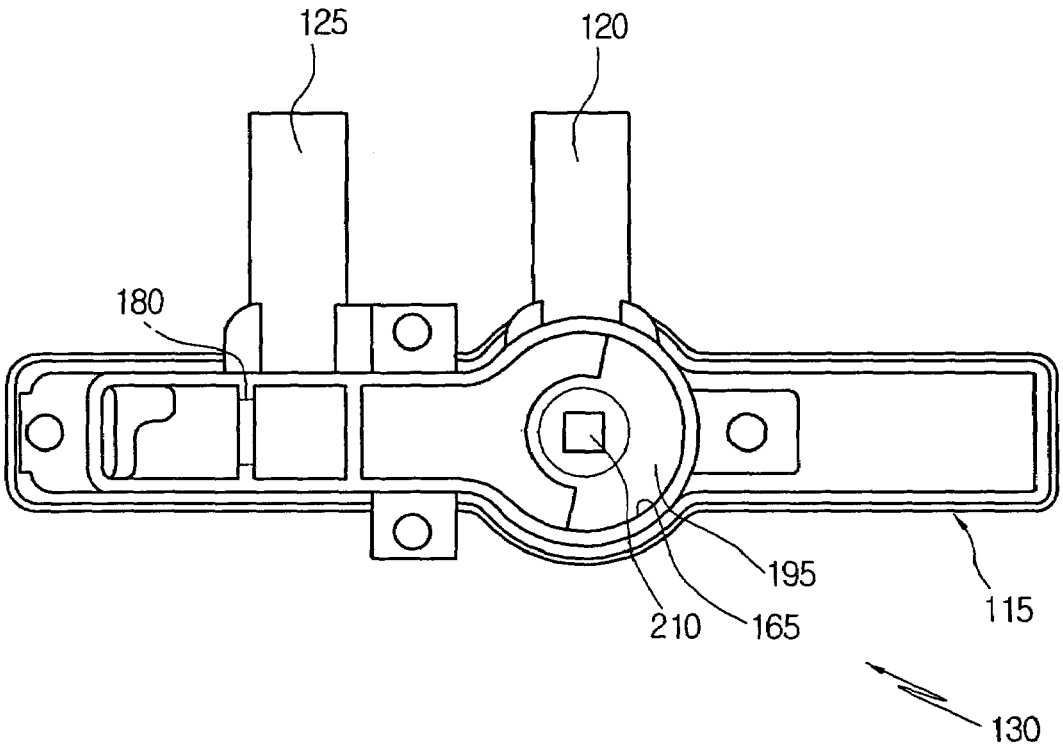
FIG. 14 is a plan view of a heat exchanger according to a second embodiment of the present invention.

FIG. 14 is a plan view of a heat exchanger according to a second embodiment of the present invention, in which those components and functions different from those of the first embodiment will be described without repeatedly explaining the same or similar parts.

As shown in FIG. 14, the second embodiment has an overall construction substantially the same as that of the first embodiment except that medium-regulating means 130 and a bypass hole 185 are closed.

The medium-regulating means 130 includes a valve body 195 installed at a guide section 165 of an upper tank 115 to selectively open/close (a portion or entire portion of) an entrance of distribution holes, a rotary member 210 coupled with the valve body 195 via an elastic member 215, a cover 220 rotatably supporting a top end of the rotary member 210 and closing a top portion of the upper tank 115 from the outside and an auxiliary rotary member 225 coupled with the top end of the rotary member 210, which is projected out of the cover 220, and connected with an actuator (not shown).

Except that the link 205 and the auxiliary valve body 200 of the medium-regulating means 130 of the first embodiment, the construction of the medium-regulating means 130 of the second embodiment is substantially the same as the that of medium-regulating means 130 of the first embodiment, and therefore those same parts will not be described repeatedly.

Correspondingly to the construction of the medium-regulating means 130, a recovery guide hole 180 is provided at one side with respect to a medium-outlet pipe 125 to communicate with a recovery section 175 and the medium-outlet pipe 125, and the other side is designed to cut off the communication between the guide section 165 and the medium-outlet pipe 125.

As the auxiliary rotary member 225 is rotated to a specific angle with a control switch in the circulation of heat exchange medium, the valve body 195 is rotated to open some (or entire ones) of the distribution holes 170. Then, the opened distribution holes 170 come to communicate with some or entire ones of the distribution passages 190 and the supply holes 145, and then the supply holes 145 communicate with specific ones of the tubes 105 that are divided into specific numbers by both partitions 160.

As a result, after being fed through the medium-inlet pipe 120, heat exchange medium flows through the specific tubes 105 communicating with the distribution holes 170, which are opened in response to the rotation of the valve body 195, while performing heat exchange with the ambient air, and then flows into a lower tank 134.

After having flown into the lower tank 134, heat exchange medium returns into the upper tank 115 via the return pipe 140, and then discharges into the medium-outlet pipe 125.

Figure 15:
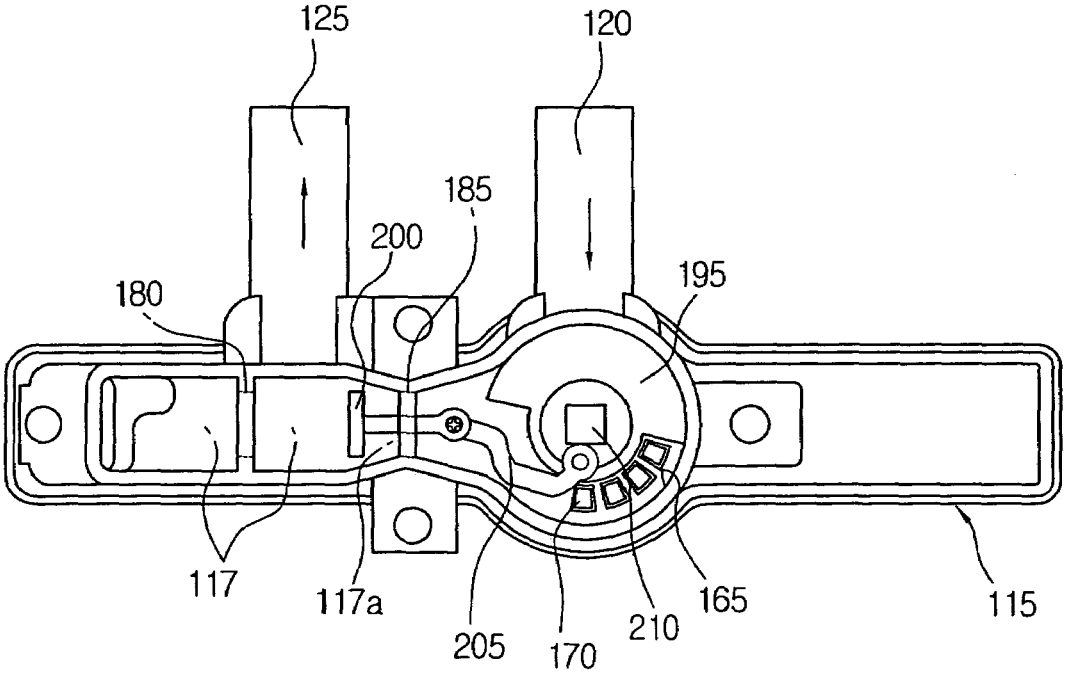
FIG. 15 is a plan view of a heat exchanger according to a third embodiment of the present invention.

FIG. 15 is a plan view of a heat exchanger according to a third embodiment of the present invention, in which those components and functions different from those of the first embodiment will be described without repeatedly explaining the same or similar parts.

As shown in FIG. 15, the third embodiment of the present invention has an overall construction and functions substantially the same as those of the first embodiment except that a bypass passage 117*a* is formed through the reduction of the cross section of an internal passage 117 in a region of an upper tank 115 where a bypass hole 185 is formed.

Herein it is preferred that the bypass passage 117*a* is tapered, and formed between a medium-inlet pipe 120 and a medium-outlet pipe 125.

The bypass hole 185 is preferably formed in portion of the bypass passage 117*a* having the smallest cross-sectional area, and allows heat exchange medium fed through the medium-inlet pipe to directly flow into the medium-outlet pipe 125.

The tapered bypass passage 117*a* is so shaped to increase its cross-sectional area as leading along a flowing direction of heat exchange medium from the position where the bypass hole 185 is formed. This as a result enables the flow rate of heat exchange medium to be varied according to temperature control positions by medium-regulating means 130.

That is, the auxiliary valve body 200 gradually opens the bypass hole 185 from a completely closed position, the gap between the auxiliary valve body 200 and the bypass passage 117*a* gradually increases resultantly increasing the quantity of bypassing medium.

When the auxiliary valve body 200 is operated to flow heat exchange medium through the bypass passage 117*a*, it is possible to control the flow of heat exchange medium varied according to temperature control positions of the medium-regulating means 130 without abrupt change in flow rate. As a result, this can efficiently carry out temperature control while constantly maintaining the quantity and the flow rate of heat exchange medium flowing through the tubes 105, thereby reducing any lateral temperature difference in the tubes.

In addition, even though the bypass hole 185 is opened to a certain degree in an initial stage, only a small quantity of heat exchange medium flows through the bypass hole 185 and thus a sufficient quantity of heat exchange medium is ensured to improve heat exchange performance.

Figure 16:
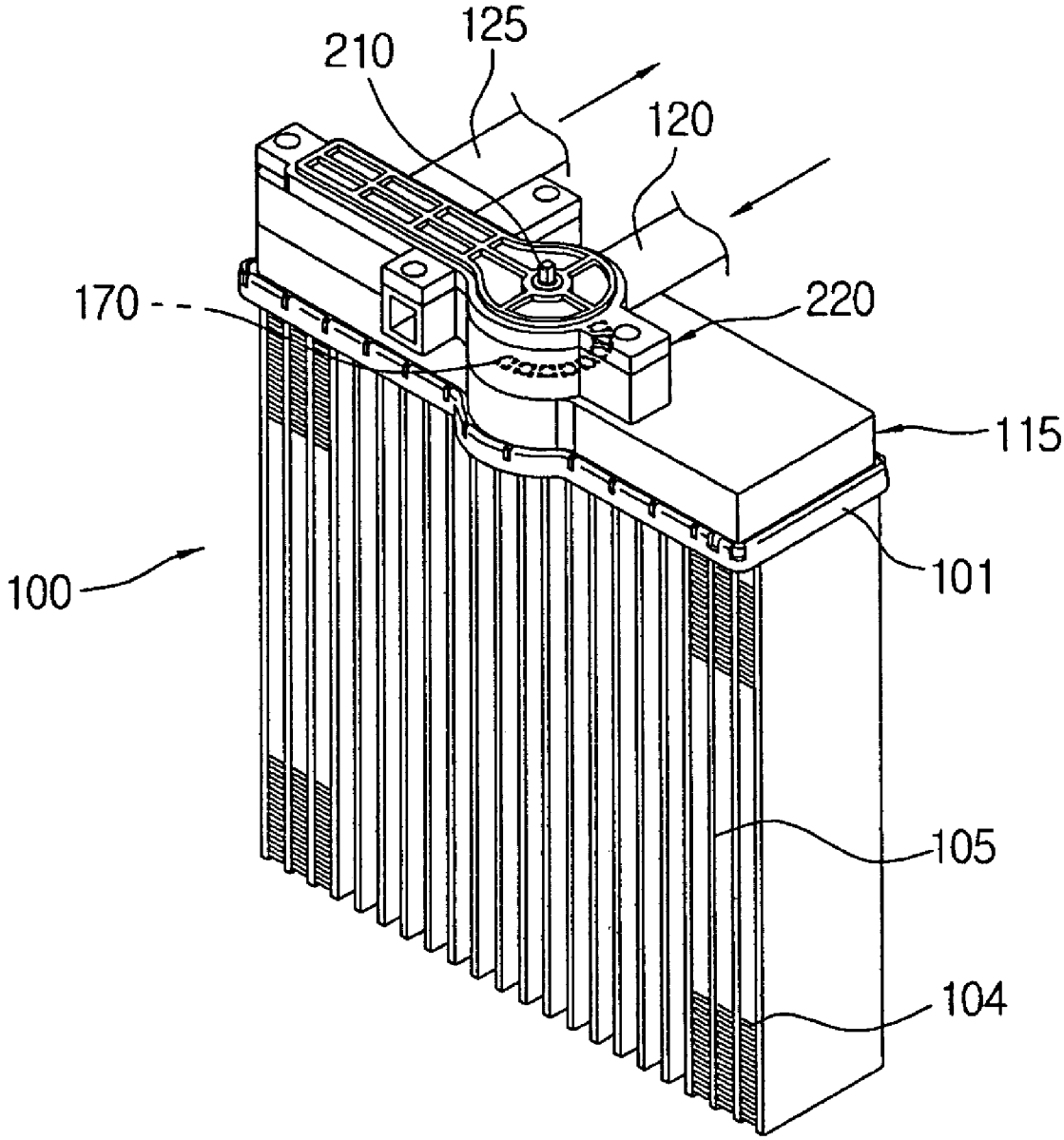
FIG. 16 is a plan view of a heat exchanger according to a fourth embodiment of the present invention.
Figure 17:
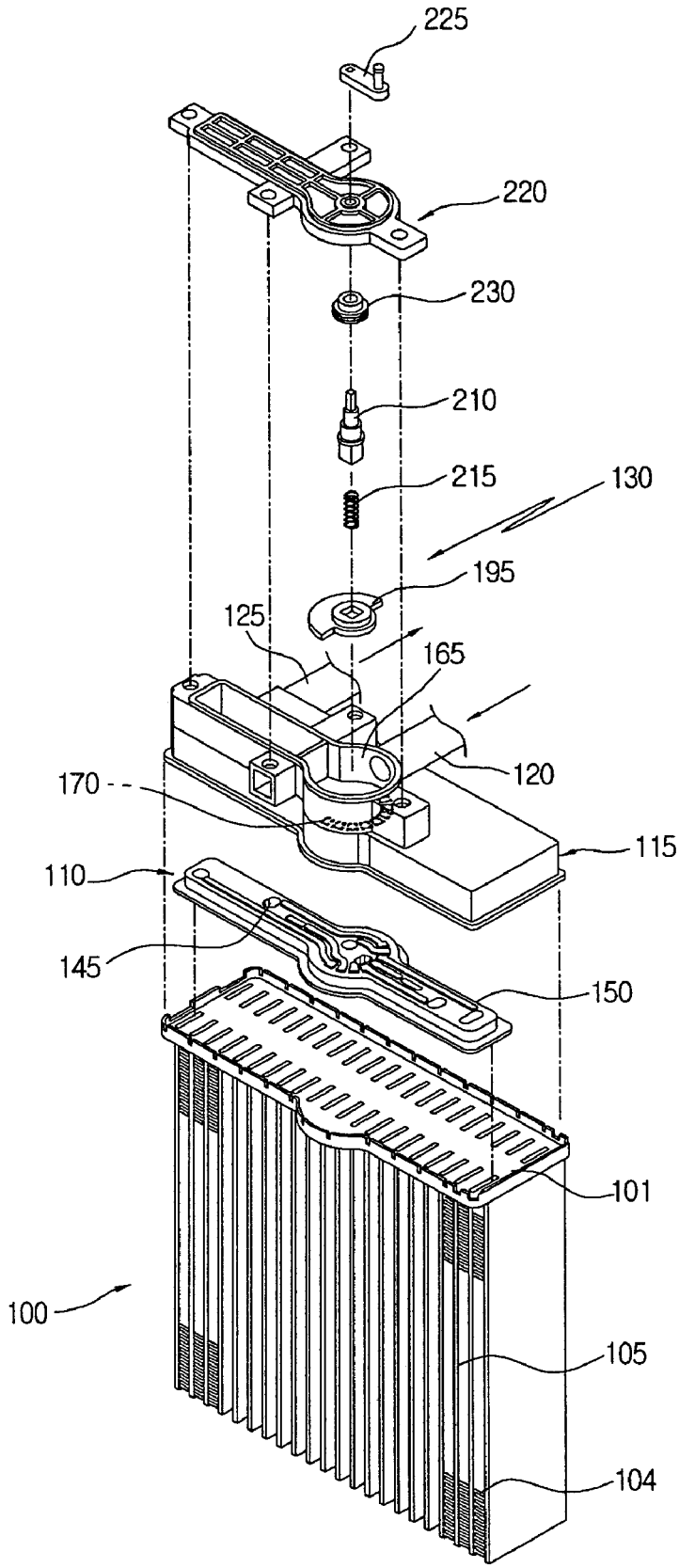
FIG. 17 is an exploded perspective view of the heat exchanger according to the fourth embodiment of the present invention.
Figure 18:
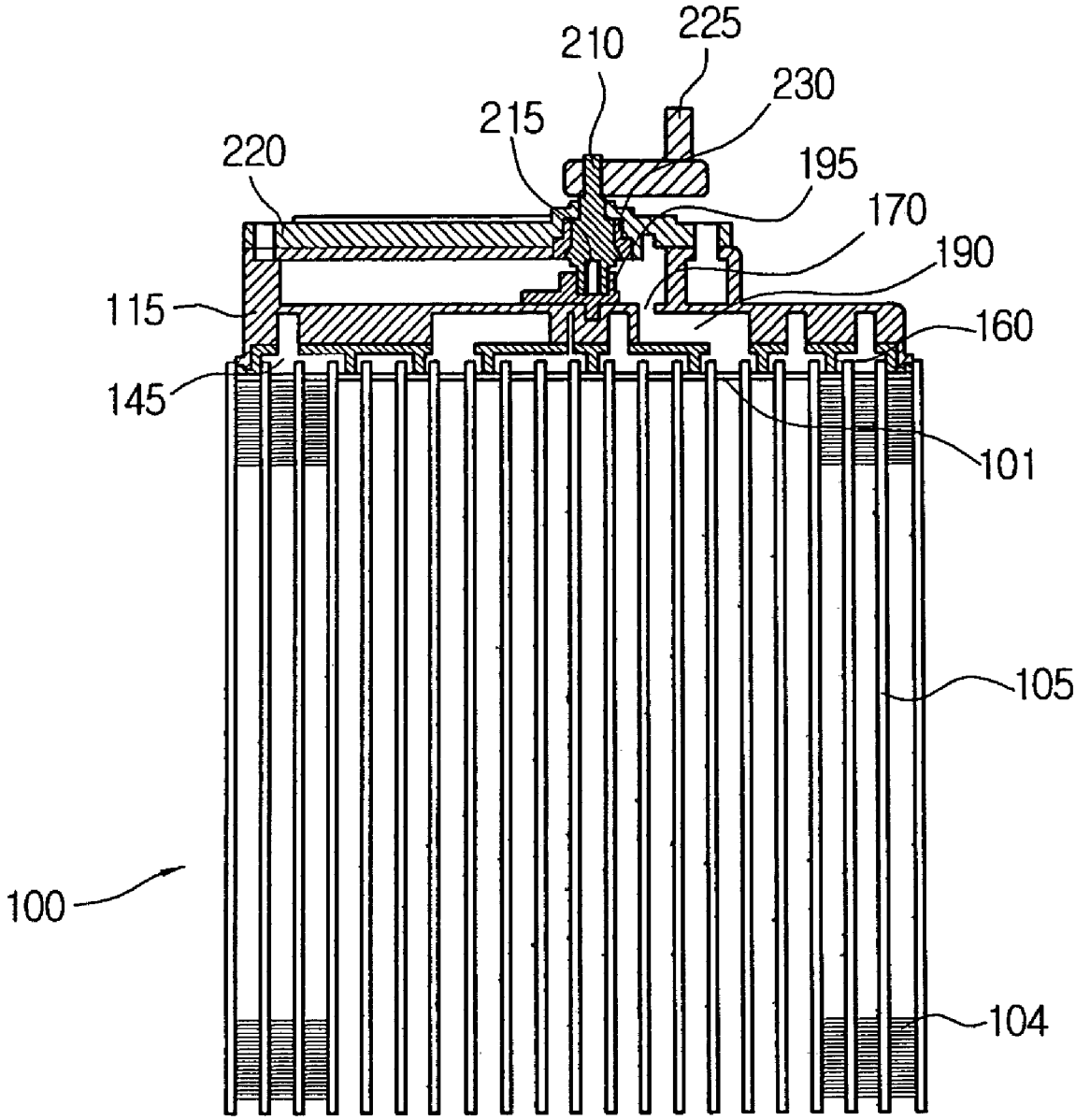
FIG. 18 is a front elevation view of the heat exchanger according to the fourth embodiment of the present invention.
Figure 19:
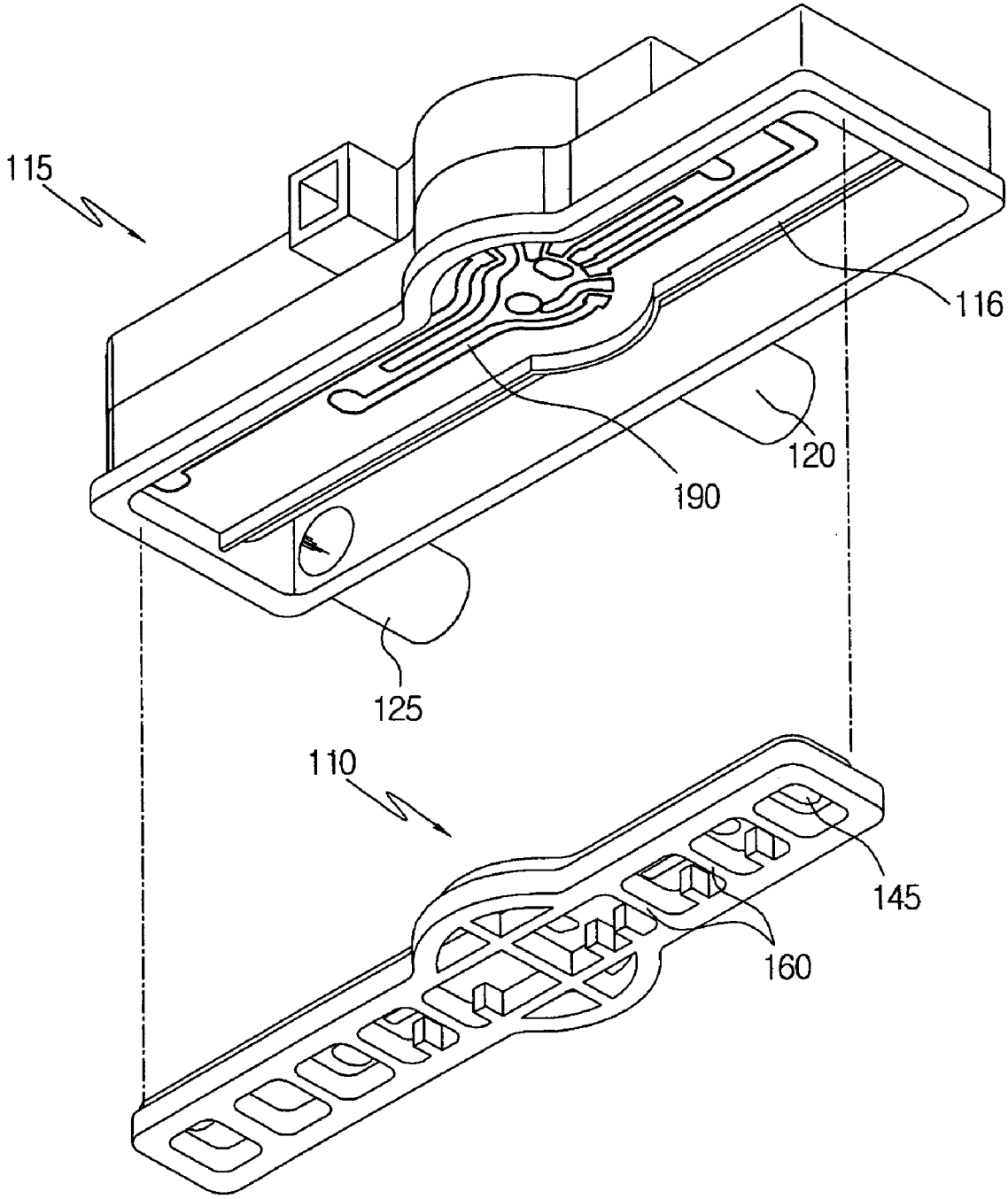
FIG. 19 is an exploded perspective view of a tank and medium-distributing means in the heat exchanger according to the fourth embodiment of the present invention.
Figure 20:
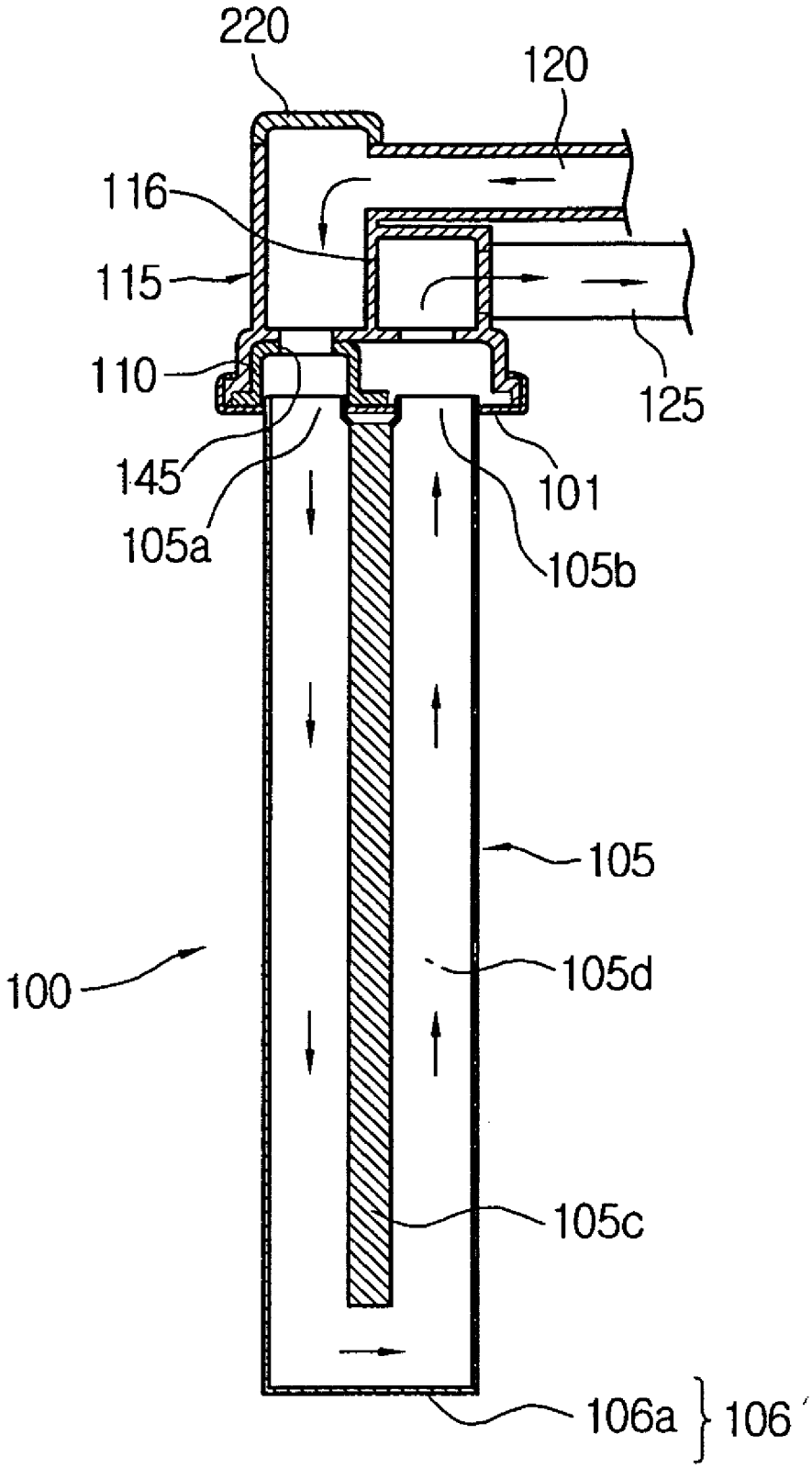
FIG. 20 is a vertical cross-sectional view of the heat exchanger according to the fourth embodiment of the present invention.
Figure 21:
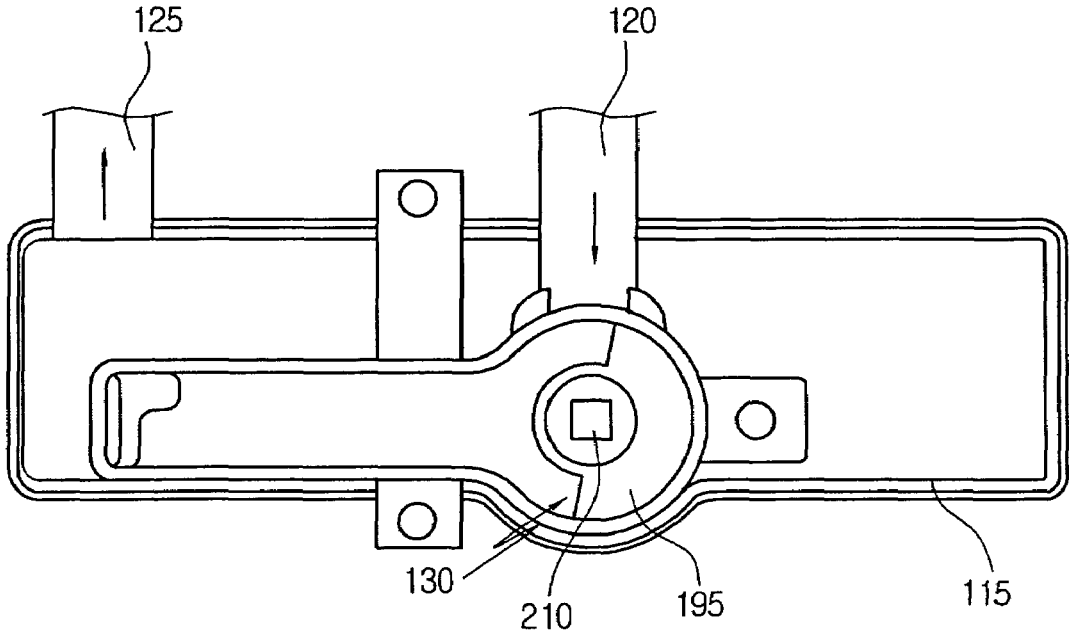
FIG. 21 is a plan view of the heat exchanger according to the fourth embodiment of the present invention.
Figure 22:
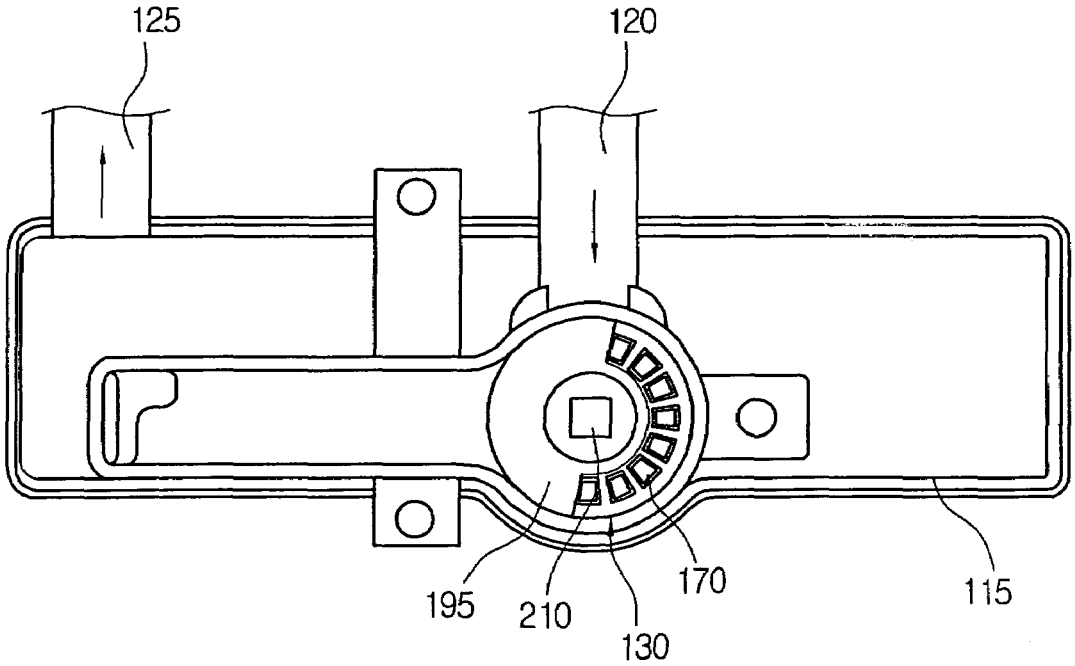
FIG. 22 is a plan view illustrating an operation status of the heat exchanger according to the fourth embodiment of the present invention.

FIG. 16 is a plan view of a heat exchanger according to a fourth embodiment of the present invention, FIG. 17 is an exploded perspective view of the heat exchanger according to the fourth embodiment of the present invention, FIG. 18 is a front elevation view of the heat exchanger according to the fourth embodiment of the present invention, FIG. 19 is an exploded perspective view of a tank and medium-distributing means in the heat exchanger according to the fourth embodiment of the present invention, FIG. 20 is a vertical cross-sectional view of the heat exchanger according to the fourth embodiment of the present invention, FIG. 21 is a plan view of the heat exchanger according to the fourth embodiment of the present invention, and FIG. 22 is a plan view illustrating an operation status of the heat exchanger according to the fourth embodiment of the present invention, in which those components and functions different from those Qf the first embodiment will be described without repeatedly explaining the same or similar parts.

While the tubes are arranged in a single row to contain linear passages therein in the foregoing first embodiment, the fourth embodiment has U-shaped passages in the tubes.

Accordingly, a heat exchanger 100 of the fourth embodiment includes a number of tubes 105 arranged at an interval, in which each of the tubes 105 has opened inlet and outlet 105*a* and 105 coupled with a header 101 and a U-shaped passage 150*d* formed therein to connect the inlet 105 with the outlet 105*b*, medium-distributing means 110 installed at the header 101 to feed heat exchange medium to a specific one or entire ones of the tubes 105 and a tank 115 installed at the header 101 to contain the medium-distributing means 110. The tank 115 has the medium-inlet pipe 120 for feeding heat exchange medium, a medium-outlet pipe 125 for discharging heat exchange medium and distribution passages 190 for feeding heat exchange medium to specific regions of the medium-distributing means 110. The heat exchanger 100 also includes medium-regulating means 130 installed inside the tank 115, in which the medium-regulating means 130 is automatically operated in response to a control signal to specify the quantity of heat exchange medium to be fed.

In addition, the heat exchanger 100 may further include heat radiating fins 104 between adjacent ones of the tubes 105 to promote heat exchange.

First, in order to feed heat exchange medium into the tubes 105 without flow resistance, the medium-distributing means 110 has a number of supply holes 145 in suitable positions, in which each of the supply holes 145 communicates with specific ones of the tubes 105 divided into several regions. The medium-distributing means 110 also includes guides 150 in an upper part to close opened lower ends of the distribution passages 190 so that heat exchange medium flowing through the distribution passages 190 can be guided into the supply holes 145. In addition, partitions 160 are provided between respective ones of the supply holes 145.

The partitions 160 allow heat exchange medium to fed through the supply holes 145 into the specific tubes 105 that are divided by the partitions 160.

Herein, the medium-distributing means 110 is preferably made of rubber or synthetic resin. That is, the medium-distributing means 110 is installed at the side of the inlets 105*a* of the tubes 105 between the tank 115 and the header 101 to minimize heat transfer between heat exchange medium flowing into the inlets 105*a* of the tubes 105 and that discharging via the outlets 105*b* of the tubes 105. In addition, the medium-distributing means 110 also allow heat exchange medium fed through the medium-inlet pipe 120 to be introduced into the inlets 105*a* only.

In the meantime, modification to the position and number of the partitions 160 of the medium-distributing means 110 can variously change the number and size of the passages of heat exchange medium flowing through the partitioned tubes 105. Also, modification to the position and configuration of the guides 150 of the medium-distributing means 110 and the distribution passages 190 of the tank 115 can selectively change the sequence of feeding heat exchange medium into the passages divided by the partitions 160.

The upper tank 115 includes a circular guide section 165 communicating with the medium-inlet pipe 120 and a number of distribution holes 170 at the bottom of the guide section 165. The distribution holes 170 are placed radially at an equal interval to feed heat exchange medium into the medium-distributing means 110' via the distribution passages 190.

Inside the tank 115, there is provided a separator 116 to separate heat exchange medium flowing into the inlets 105*a* of the tubes 105 from that discharging from the outlets 105*b* of the tubes 105.

The medium-inlet pipe 120 of the tank 115 is placed opposite to the medium-outlet pipe 125 of the tank 115 with respect to the separator 116, in which the medium-inlet pipe 120 is installed to communicate with the inlets 105*a* of the tubes 105 and the medium-outlet pipe 125 is installed to communicate with the outlets 105*b* of the tubes 105.

The distribution passages 190 are provided in a lower part of the tank 115 to correspond to the guides 150 of the medium-distributing means 110. The distribution passages 190 are provided at a suitable interval corresponding to the guides 150, and have leading ends communicating with the distribution holes 170 and rear ends extended to the position of the supply holes 145 of the medium-distributing means 110.

That is, each of the distributing passages 190 has a specific shape and length to communicated with each of the distribution holes 170 of the guide section 165 and each of the supply holes 145 of the medium-distributing means 110.

When coupled with the guides 150, the distribution passages 190 form closed passages so that heat exchange medium fed through the distribution holes 170 of the guides 165 can stably flow into the supply holes 145 of the medium-distributing means 110.

The medium-regulating means 130 includes a valve body 195 placed in the guide section 165 of the upper tank 115 to selectively open/close (partially or completely) an entrance of the distribution holes 170, rotary member 210 coupled with the valve body 195 via an elastic member 215, a cover 220 supporting the rotary member 210 while closing an opened upper part of the tank 115 from the outside and an auxiliary valve body 225 coupled with a portion of the rotary member 210 projected out of the cover 220 and connected with an actuator (not shown).

The valve body 195 is automatically controlled and rotated by a control switch (not shown), and made of Teflon or urethane in order to improve heat resistance and sealing ability.

The elastic member 215 comprises for example a spring so that the valve body 195 can be in tightly pressed against the bottom of the guide section 165, and a sealing member 230 is placed between the rotary member 210 and the cover 220 to maintain the cover 220 and the upper tank 115 in a sealed state.

In addition, where the valve body is made of synthetic resin, rubber may be coated on the valve body 195. Where the valve body 195 is coated stepwise with synthetic resin and rubber, it is possible to enhance the sealing ability between the distribution holes 170 and the valve body 195.

Each of the tubes 105 has an integral structure having a partition wall 105*c* to form a U-shaped passage.

In addition, return means 106 is provided at the bottom of the integral tube 105, and has a closure wall 106*a* formed at the bottom of the tube 105.

That is, in the integral tube 105, the inlet and outlet 105*a* and 105*b* are opened at the top, the closure wall 106*a* closes the bottom and the partition wall 105*c* is extended to a specific length between the inlet 105*a* and the outlet 105*b* within the tube 105 so as to form the U-shaped passage 105*d* connecting the inlet 105*a* and the outlet 105*b* within the tube 105.

As described above, the heat exchanger 100 according to the fourth embodiment of the present invention is realized by coupling the header 101 to the tops of the tubes 105, installing the medium-distributing means 110 in the header 101, and coupling the tank 115 on the header 115, in which the medium-regulating means 130 are mounted on the tank 115.

Therefore, the flow of heat exchange medium through the heat exchanger can be selectively adjusted or cut off to control heating or cooling capacity and at the same time minimize temperature variation.

A circulation process of heat exchange medium will be described in detail as follows:

In the circulation of heat exchange medium, when the auxiliary rotary member 225 is rotated to a specific angle, the valve body 195 rotates to open some of the distribution holes 170, which in turn communicate with some or entire ones of the distribution passages 190 and the supply holes 145, and then the some or entire ones of the supply holes 145 communicate with some or entire ones of the inlets 105*a* of the tubes 105 which are divided into several groups by the partitions 160.

Therefore, heat exchange medium fed via the medium-inlet pipe 120 is introduced into the inlets 105*a* of the tubes 105 communicating with the distribution holes 170, which are opened in response to the rotation of the valve body 195, and flows along the U-shaped passages 105*d* of the tubes 105 to perform heat exchange with the ambient air, and then is discharged through the outlets 105*b* of the tubes 105.

After being discharged through the outlets 105*b* of the tubes 105, heat exchange medium flows through the tank 115, which is divided by the separator, and is finally discharged to the medium-outlet pipe 125.

When the auxiliary valve body 225 is completely rotated, the whole distribution holes 170 are opened in response to the rotation of the valve body 195, and therefore communicate with the inlets 105*a* of the whole tubes 105 via the distribution passages 190 and the supply holes 145.

Therefore, heat exchange medium fed via the medium-inlet pipe 120 is introduced into the inlets 105*a* of the whole tubes 105 communicating with the distribution holes 170, which are opened in response to the rotation of the valve body 195, and flows along the U-shaped passages 105*d* of the tubes 105 to perform heat exchange with the ambient air, and then is discharged through the outlets 105*b* of the tubes 105.

In succession, heat exchange medium discharged via the outlets 105*b* of the tubes 105 flows through the tank 115, which is divided by the separator 116, and is finally discharged into the medium-outlet pipe 125.

The tubes 105 of the U-shaped passages 105*d* are designed to minimize vertical temperature variation of heat exchange medium flowing through the U-shaped passages 105*d* as well as uniformly maintain temperature thereby improving heat exchange performance.

Figure 23:
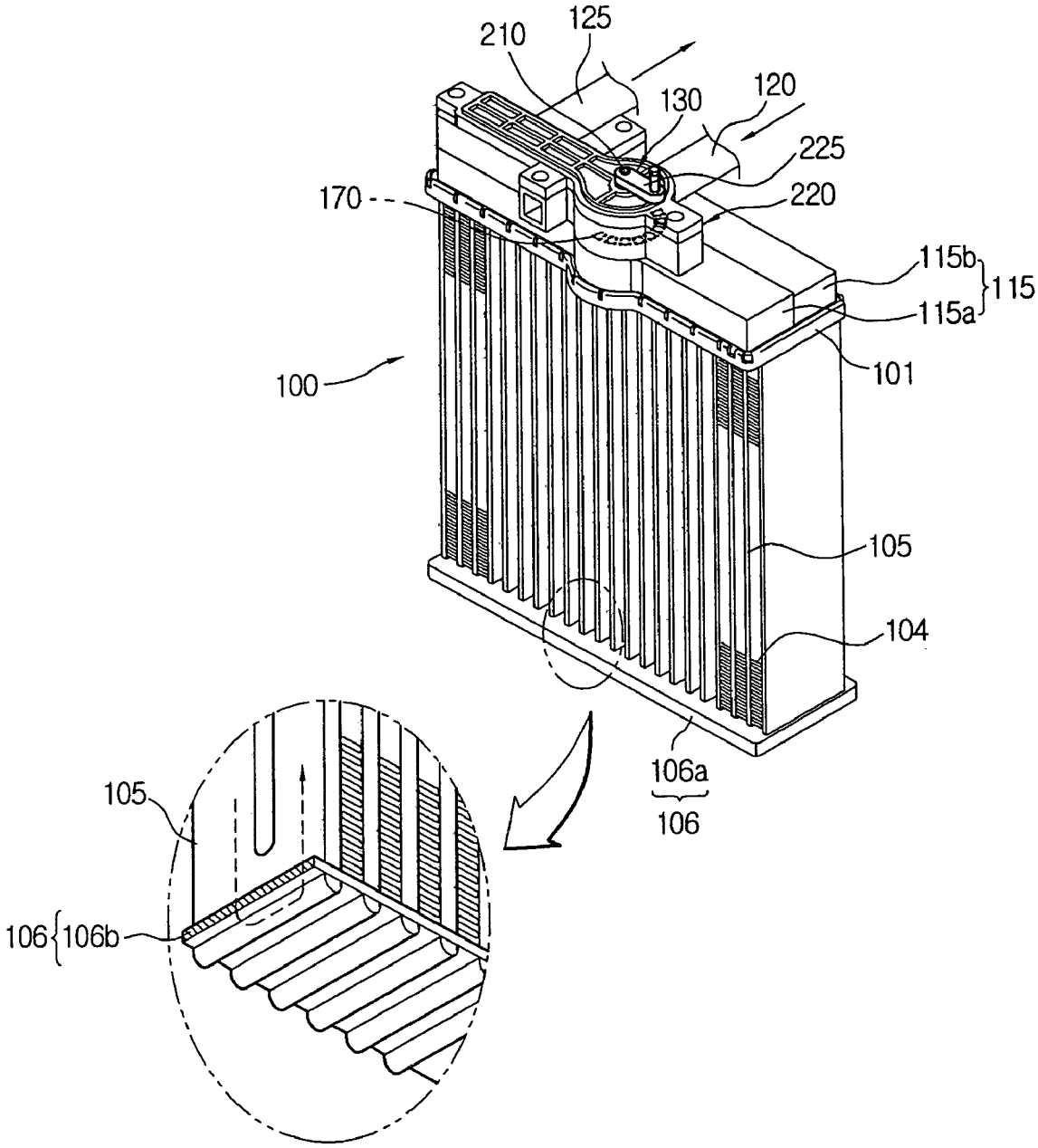
FIG. 23 is a perspective view illustrating an assembled state of a heat exchanger according to a fifth embodiment of the present invention.
Figure 24:
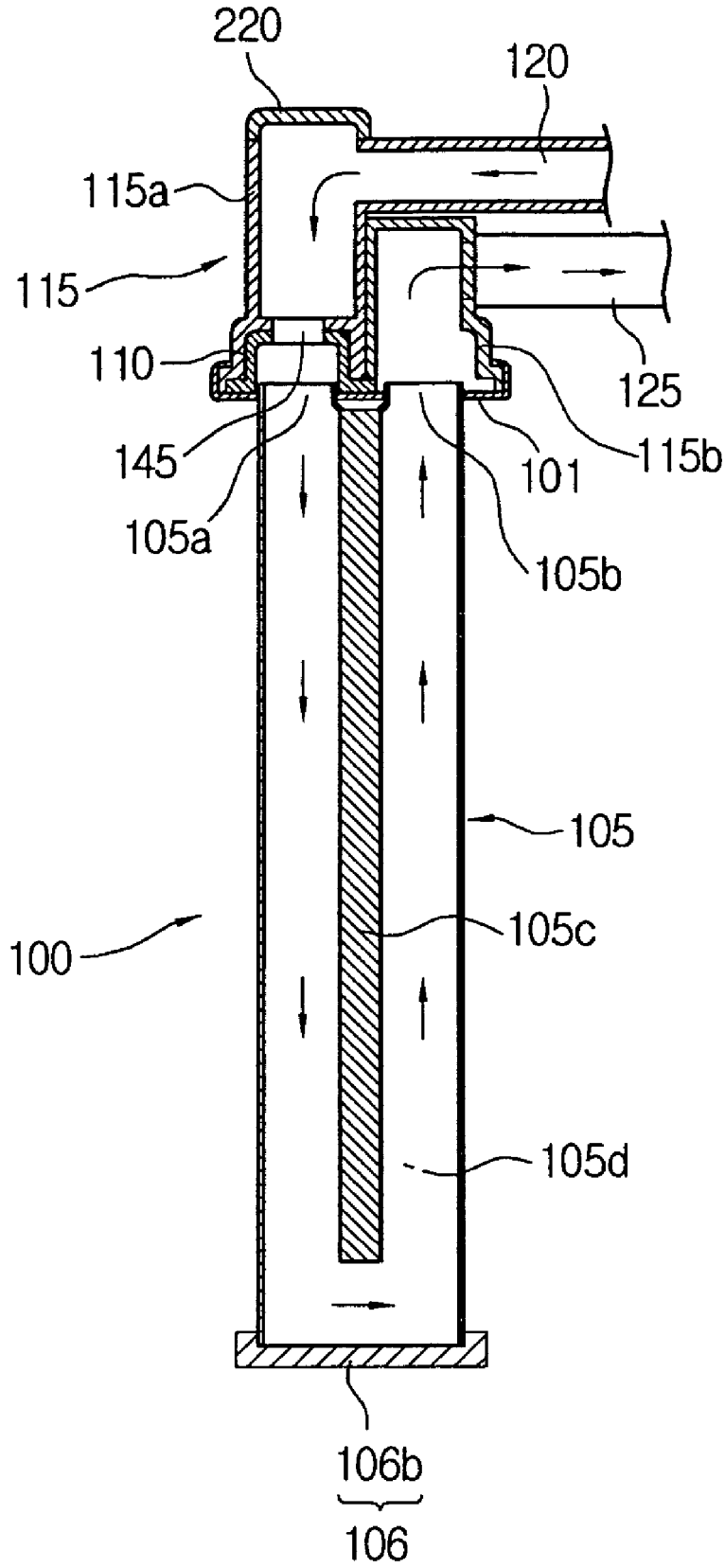
FIG. 24 is a vertical cross-sectional view the heat exchanger according to the fifth embodiment of the present invention.

FIG. 23 is a perspective view illustrating an assembled state of a heat exchanger according to a fifth embodiment of the present invention, and FIG. 24 is a vertical cross-sectional view the heat exchanger according to the fifth embodiment of the present invention, in which in which those components and functions different from those of the fourth embodiment will be described without repeatedly explaining the same or similar parts.

As shown in FIGS. 23 and 24, the heat exchanger 100 of the fifth embodiment has a construction substantially the same as that of the fourth embodiment except for a tank 115 and return means 106 of tubes 105. That is, the fourth embodiment has a single tank structure in which the separator 116 is integrally provided to separate inflow heat exchange medium from outflow heat exchange medium, whereas the fifth embodiment has a separate tank structure in which the tank 115 is separated into an inlet tank 115*a* and an outlet tank 115*b*.

The tubes 105 of the fifth embodiment are characterized by the return means 106 from the tubes 105 of the fourth embodiment. Hereinafter those parts different from those of the fourth embodiment will be described only.

First, the tank 115 includes the inlet tank 115*a* for communicating with the medium-inlet pipe 120 and the inlets 105*a* of the tubes 105 and the outlet tank 115*b* for communicating with the medium-outlet pipe 125 and the outlets 105*b* of the tubes 105.

The inlet tank 115*a* and the outlet tank 115*b* are coupled side by side with the header 101, in which the inlet tank 115*a* is coupled with a region of the header 101 at the side of the inlets 105*a* of the tubes 105, but the outlet tank 115*b* is coupled with another region of the header 101 at the side of the outlets 105*b* of the tubes 105.

The tank 115 of the fifth embodiment has the separate tank structure as above so that medium-distributing means 110 and medium-regulating means 130 are provided at the side of the inlet tank 115*a* unlike the fourth embodiment.

Each of the tubes 105 is integrally provided, and includes a partition wall 105*c* for forming a U-shaped passage 105*d* and return means 106 at the bottom, in which the return means 106 of this embodiment is different from that of the fourth embodiment.

The return means 106 is realized by closing a return plate 106*b* to the bottom of the tube 105.

That is, the integral tube 105 is provided with the opened inlet and outlet 105*a* and 105*b* at the top, the return plate 106*b* closing the bottom and the partition wall 105*c* vertically extended to a specific length between the inlet 105*a* and the outlet 105*b* inside the tube 105 to form the U-shaped passage 105*d* connecting the inlet 105*a* and the outlet 105*b* together within the tube 105.

A circulation process of heat exchange medium in the fifth embodiment of the present invention is substantially the same as that of the fourth embodiment. Describing it in brief, heat exchange medium is fed into the inlet tank 115*a* via the medium-inlet pipe 120, is introduced into the medium-regulating means 130 and the medium-distributing means 110, flows along the U-shaped passage 105*d* of the tube 105 to perform active heat exchange with the ambient air, and discharges through the outlet 105*b* of the tube 105.

After discharged via the outlets 105*b* of the tubes 105, heat exchange medium flows through the outlet tank 115*b* to finally discharge to the medium-outlet pipe 125.

Figure 25:
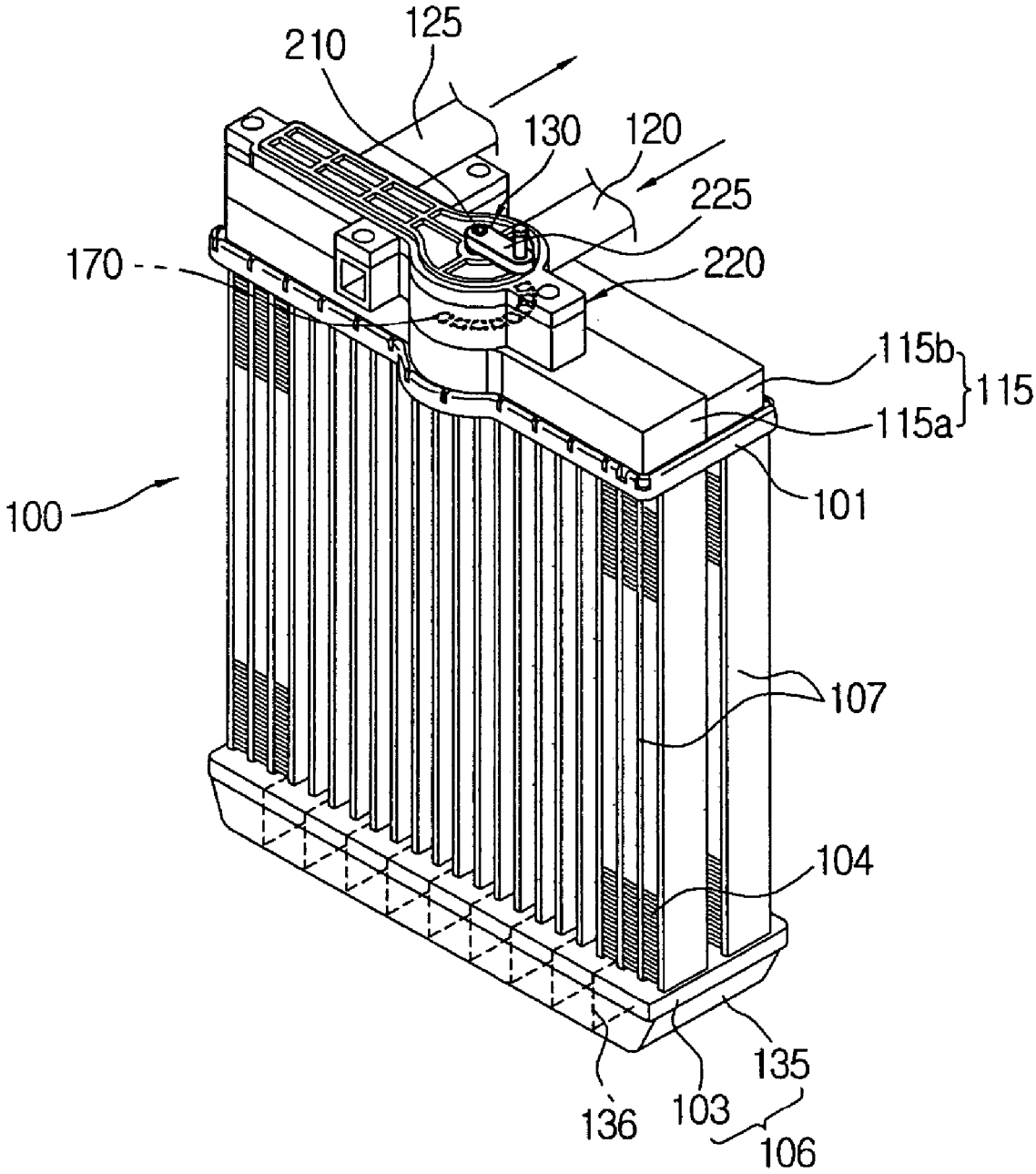
FIG. 25 is a perspective view illustrating an assembled state of a heat exchanger according to a sixth embodiment of the present invention.
Figure 26:
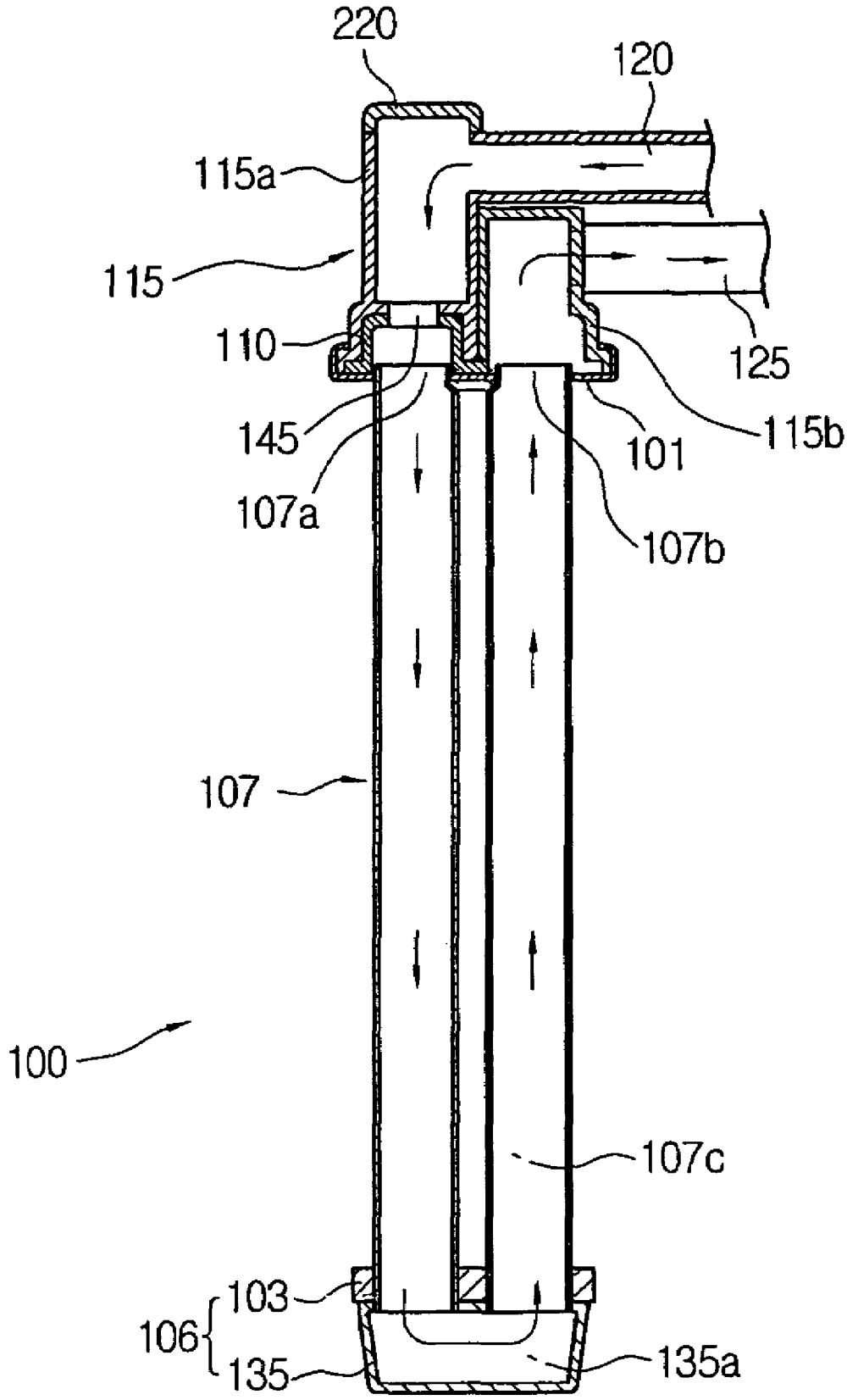
FIG. 26 is a vertical cross-sectional view the heat exchanger according to the sixth embodiment of the present invention.

FIG. 25 is a perspective view illustrating an assembled state of a heat exchanger according to a sixth embodiment of the present invention, and FIG. 26 is a vertical cross-sectional view the heat exchanger according to the sixth embodiment of the present invention; in which in which those components and functions different from those of the fifth embodiment will be described without repeatedly explaining the same or similar parts.

As shown in FIGS. 25 and 26, a heat exchanger 100 of the sixth embodiment has a construction substantially the same as that of the fifth embodiment except for tubes 107 and return means 106. That is, the tubes 107 of the sixth embodiment have a separate structure while the tubes 105 of the fifth embodiment have the integral structure. Hereinafter those parts different from those of the fifth embodiment will be described only.

The tubes 107 are separated into those communicating with inlet side of heat exchange medium and those communicating with outlet side of heat exchanger medium.

The return means 106 are provided at the bottom of the tubes 107, and have a structure different from those of the fourth and fifth embodiments.

The return means 106 includes a header 103 coupled with the bottoms of the separate tubes 107 and a return tank 135 coupled with the header 103 and forming a communication passageway 135*a* so that the separate tubes 107 communicate with each other.

That is, the header 103 and the return tank 135 are coupled to connect the bottoms of the separate tubes 107, thereby forming the U-shaped passage 107*c* in the separate tubes 107 to connect the inlet 107*a* and the outlet 107 together.

The return tank 135 is preferably provided with baffles 136 therein in positions corresponding to partitions 160 of medium-distributing means 110. As a result, after being fed into the inlets 170*a* of specific ones of the tubes 107, which are divided into groups, heat exchange medium maintains a partitioned state while passing through the return tank 135 and then flows along the U-shaped passages 107*c* to discharge to the medium-outlet pipe 125.

In the meantime, a circulation process of heat exchange medium according to the sixth embodiment is substantially the same as those of the fourth and fifth embodiments and therefore will not be described further.

In the foregoing fourth, fifth and sixth embodiments, modification to the length of the tubes 105 and 107 can change the capacity of the heat exchanger 100. Especially, in the sixth embodiment, the length of the separate tubes 107 can be freely designed simply through the change of a cutting position in fabrication of the tubes 107, and therefore the capacity of the heat exchanger 100 can be varied more freely.

Figure 27:
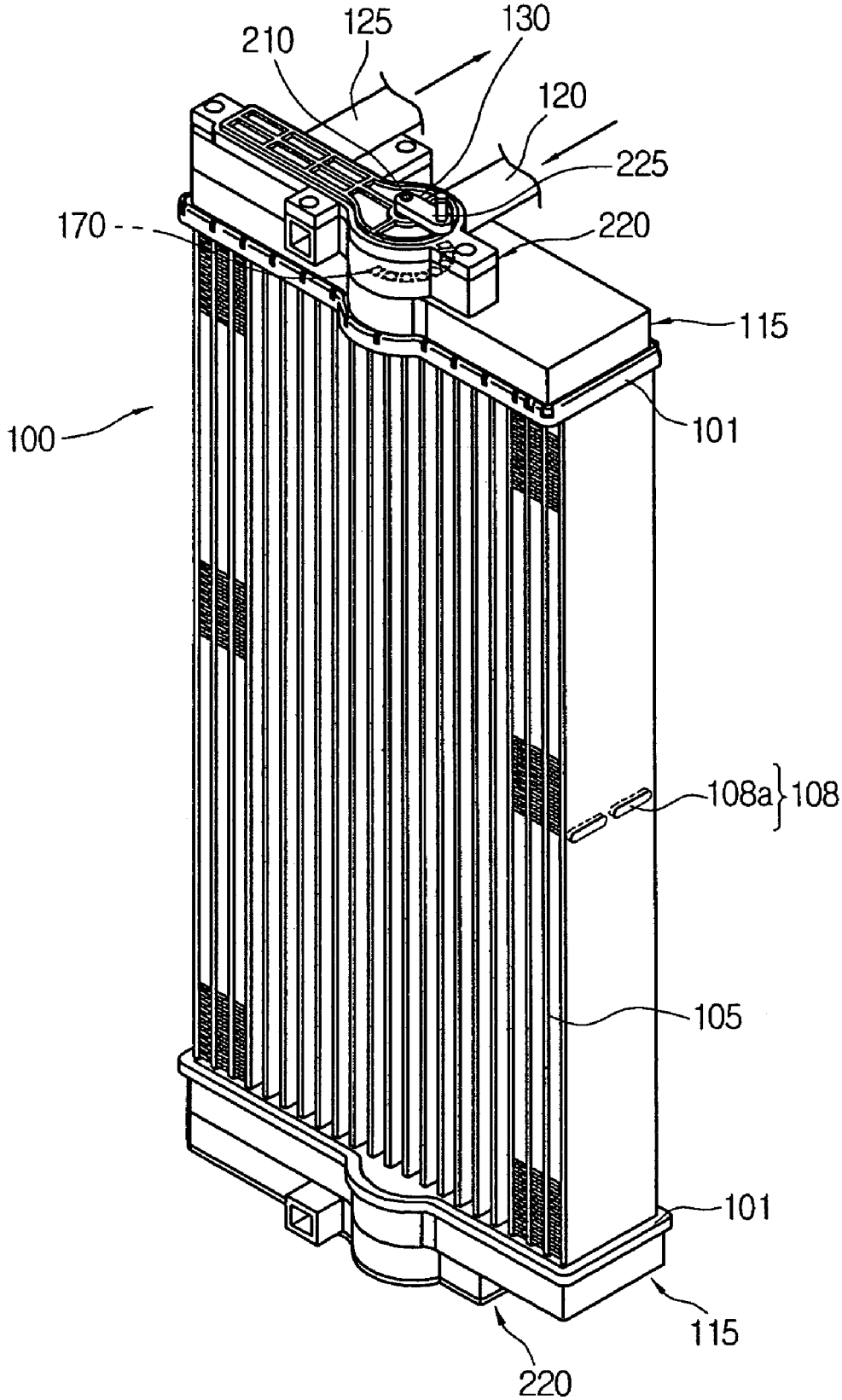
FIG. 27 is a perspective view illustrating an assembled state of a heat exchanger according to a seventh embodiment of the present invention.
Figure 28:
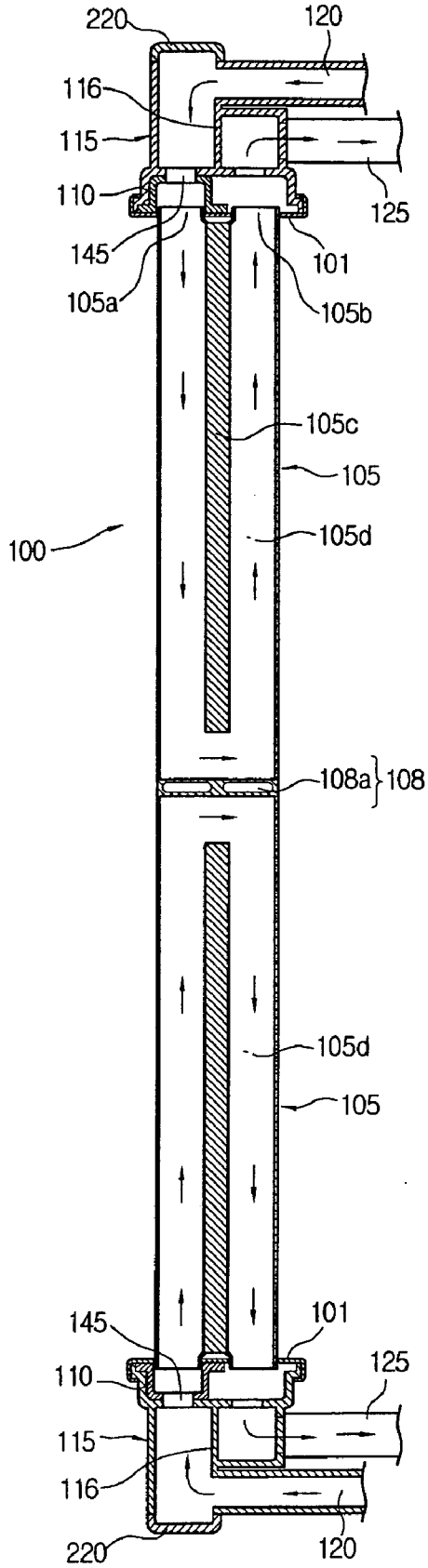
FIG. 28 is a vertical cross-sectional view the heat exchanger according to the seventh embodiment of the present invention.

FIG. 27 is a perspective view illustrating an assembled state of a heat exchanger according to a seventh embodiment of the present invention, and FIG. 28 is a vertical cross-sectional view the heat exchanger according to the seventh embodiment of the present invention, in which in which those components and functions different from those of the fourth embodiment will be described without repeatedly explaining the same or similar parts.

As shown in FIGS. 27 and 28, a heat exchanger 100 of the seventh embodiment includes tubes 105, in which each of the tubes has U-shaped passages 105*d*, which are vertically symmetrical with each other about thermal-insulating means 108, and inlets 105*a* and outlets 105*b* of the passages 105*d* formed in top and bottom ends and coupled with upper and lower headers 101. The heat exchanger 100 also includes upper and lower medium-distributing means 110 installed at the upper and lower headers 101, respectively, to feed heat exchange medium to specific ones or whole ones of the tubes 105, and upper and lower tanks 115 containing the upper and lower medium-distributing means 110, respectively, and coupled with the upper and lower headers 101, respectively. Each of the upper and lower tanks 115 has a medium-inlet pipe 120, a medium-outlet pipe 125 and a distribution passageway 190 for feeding heat exchange medium to a specific region of the medium-distributing means 110. In addition, the heat exchanger 100 also includes upper and lower medium-regulating means 130 installed at the upper and lower tanks 115, respectively, and operated in response to a control signal to specify the quantity of heat exchange medium to be fed.

Hereinafter those parts different from those of the fourth embodiment will be described only.

The seventh embodiment is of a structure applied to an air conditioning system in which right and left sections are controlled independently from each other, and has a construction and operations substantially the same as those of the heat exchanger 100 of the fourth embodiment except that another heat exchangers 100 of the same structure are connected symmetrically in serial with first heat exchangers 100.

To this end, tubes 105 having U-shaped passages 105*d* as in the fourth embodiment may be butt welded together. It is more preferable to integrally form tubes 105 in such a fashion so that U-shaped passages 105*d* are formed vertically symmetrically about thermal-insulating means 108.

The thermal-insulating means 108 are realized by perforating thermal-insulating holes 108*a* between the upper and lower U-shaped passages 105*d*, respectively.

Therefore, the thermal-insulating holes 108*a* insulate heat transfer between heat exchange medium flowing through the upper U-shaped passages 105*d* and that flowing through the lower U-shaped passages 105*d*.

Also, while it has been illustrated that the heat exchanger 100 is vertically arranged, the heat exchanger 100 may be mounted horizontally in practice on the air conditioning system so that a driver's seat can be temperature-controlled independently from passenger's seat.

Then, the air controlling system having right and left sections controlled independently from each other can be designed without a temperature door for temperature control between the driver's seat and the passenger's seat. As a result, the heat exchanger 100 of the seventh embodiment alone can independently control the temperature of the driver's seat and the passenger's seat.

That is, the upper and lower medium-regulating means 130 installed at the upper and lower tanks 115 are operated independently to regulate the quantity of heat exchange medium fed into the upper and lower passages 105*d* of the tubes 105, respectively, so that the temperature of the driver's seat and passenger's seat can be controlled separately.

In the present invention as set forth above, the medium-regulating means can be so operated to feed heat exchange medium to specific ones or whole ones of the tubes while suitably regulating the quantity of heat exchange medium, thereby simply adjusting the heat exchange performance according to cooling/heating load. In addition, heat exchange medium is distributed and circulates through specific tubes or whole tubes without flow resistance to improve mixing ability and whole heat exchange performance.

In addition, the medium-distributing means is made of rubber or synthetic resin to minimize the heat transfer between heat exchange medium flowing into tubes and that bypassing the tubes.

The distribution passages, the guides and the supply holes are provided in a fashion spreading into both sides from the guide section so that heat exchange medium can be fed into the tubes in a predetermined quantity and the quantity can be regulated stepwise to enable precise temperature control.

In addition, the distribution passages, the guides and the partitions can be variously modified in position so that the number and shape of the passages of heat exchange medium flowing into specific tubes can be adjusted freely.

The distribution holes of heat exchange medium communicating with tubes, which are grouped by specific numbers, are sized in proportion to the numbers of the corresponding tubes to uniformly maintain the quantity and the rate of heat exchange medium flowing toward the tubes, thereby preventing lateral temperature difference in the tubes and improving heat exchange performance.

In addition, the tapered bypass passage is formed by reducing the cross section of the inner passage of the upper tank in order to regulate the quantity of bypassing heat-exchange medium differently according to temperature control positions of the medium-regulating means. This as a result can enable efficient temperature control as well as uniformly maintain the quantity and the flow rate of heat exchange medium flowing toward the tubes to prevent lateral temperature difference.

Even though the bypass hole is opened to a predetermined degree at an early stage, the quantity of bypassing medium is small and thus a sufficient quantity of medium can be ensured to improve heat exchange performance and flow control performance.

Furthermore, the tubes having the U-shaped passages can minimize vertical temperature variation.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A heat exchanger comprising:

a plurality of tubes placed between upper and lower headers, each tube having both ends fixed to the headers;

medium-distributing means installed at the upper header for supplying specific tubes with heat exchange medium;

an upper tank placed over the medium-distributing means, the upper tank having a medium-inlet pipe, a medium-outlet pipe and distribution passages for supplying specific regions of the medium-distributing means with heat exchange medium;

medium-regulating means installed at the upper tank; and a lower tank coupled with the lower header to communicate with lower ends of the tubes, and connected with the upper tank via a return pipe;

wherein the medium-distributing means comprises:

a number of supply holes each communicating with tubes which are divided into groups;

guides provided at a top portion of the medium-distributing means for closing opened lower ends of the distribution passages while guiding heat exchange medium, which flows through the distribution passages, to the respective supply holes; and a recovery hole for communicating with the return pipe, the upper tank comprises:

a guide section communicating with the medium-inlet pipe, the guide section having a number of distribution holes to supply the medium-distributing means with heat exchange medium;

a recovery section provided for communicating with the return pipe;

a recovery guide hole formed at one side from the medium-outlet pipe, the recovery guide hole communicating with the recovery section and the medium-outlet pipe; and a bypass hole formed at the other side from the medium-outlet pipe, the bypass hole communicating with the guide section and the medium-outlet pipe.

2. The heat exchanger according to claim 1, wherein the medium-distributing means is made of rubber.

3. The heat exchanger according to claim 1, wherein the medium-distributing means is made of synthetic resin.

4. The heat exchanger according to claim 1, wherein the medium-distributing means further comprises partitions between adjacent ones of the supply holes.

5. The heat exchanger according to claim 1, wherein the supply holes of the medium-distributing means is sized in proportion to the number of the corresponding tubes communicating with the each supply holes.

6. The heat exchanger according to claim 1, wherein the upper tank comprises a bypass passage formed in a region of an upper tank where the bypass hole is formed, through the reduction of the cross section of an internal passage.

7. The heat exchanger according to claim 6, wherein the bypass passage is tapered between the medium-inlet pipe and the medium-outlet pipe.

8. The heat exchanger according to claim 1, wherein the distribution passages of the upper tank are provided at a suitable interval corresponding to the guides and the supply holes of the medium-distributing means.

9. The heat exchanger according to claim 1, wherein each of the distribution holes of the upper tank is sized in proportion to the number of the corresponding tubes communicating with the each distribution hole.

10. The heat exchanger according to claim 8, wherein each of the distribution passages has a leading end communicating with each of the distribution holes of the guide section and a rear end extended to each of the supply holes.

11. The heat exchanger according to claim 1, wherein the medium-regulating means comprises:

a valve body installed at the guide section of the upper tank to selectively open/close the distribution holes;

an auxiliary valve body in a bypass passage between the medium-inlet pipe and the medium-outlet pipe; and a link connects the valve body and auxiliary valve body so that they act in concert.

12. The heat exchanger according to claim 11, wherein the medium-regulating means further comprises:

a rotary member coupled with the valve body via an elastic member;

a cover for supporting a top end of the rotary member while closing a top portion of the upper tank; and an auxiliary rotary member installed at the top end of the rotary member projected out of the cover, and connected with an actuator.

13. The heat exchanger according to claim 11, wherein the valve body is made of Teflon.

14. The heat exchanger according to claim 11, wherein the valve body is made of urethane.

15. The heat exchanger according to claim 11, wherein the valve body is made of synthetic resin and coated with rubber on the synthetic resin.

16. The heat exchanger according to claim 12, wherein the elastic member is adapted to maintain the valve body in close contact with a bottom of the guide section.

17. The heat exchanger according to claim 12, wherein the medium-regulating means further comprises a sealing member between the rotary member and the cover.

18. The heat exchanger according to claim 1, wherein the medium-regulating means comprises:

a valve body installed at the guide section of the upper tank to selectively open/close the distribution holes;

a rotary member coupled with the valve body via an elastic member;

a cover for rotatably supporting a top end of the rotary member and sealing a top portion of the upper tank; and an auxiliary rotary member coupled with the top end of the rotary member, which is projected out of the cover, and connected with an actuator.

19. The heat exchanger according to claim 18, wherein the recovery guide hole is provided at one side of the upper tank with respect to the medium-outlet pipe to communicate with the recovery section and the medium-outlet pipe, wherein the other side of the upper tank is designed to cut off the communication between the guide section and the medium-outlet pipe.

* * * * *